US011322167B2

(12) United States Patent
Healy et al.

(10) Patent No.: US 11,322,167 B2
(45) Date of Patent: May 3, 2022

(54) AUDITORY COMMUNICATION DEVICES AND RELATED METHODS

(71) Applicant: Ohio State Innovation Foundation, Columbus, OH (US)

(72) Inventors: Eric Healy, Dublin, OH (US); Jordan L. Vasko, Strongsville, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 17/055,430

(22) PCT Filed: May 16, 2019

(86) PCT No.: PCT/US2019/032631

§ 371 (c)(1),
(2) Date: Nov. 13, 2020

(87) PCT Pub. No.: WO2019/222477

PCT Pub. Date: Nov. 21, 2019

(65) Prior Publication Data

US 2021/0225385 A1 Jul. 22, 2021

Related U.S. Application Data

(60) Provisional application No. 62/672,118, filed on May 16, 2018.

(51) Int. Cl.
*G10L 21/0208* (2013.01)
*G10L 21/0224* (2013.01)
(Continued)

(52) U.S. Cl.
CPC ..... *G10L 21/0208* (2013.01); *G10L 21/0224* (2013.01); *G10L 21/0232* (2013.01); *G10L 25/30* (2013.01)

(58) Field of Classification Search
CPC . G10L 21/0208; G10L 21/0232; G10L 25/30; G10L 21/0224
(Continued)

(56) References Cited

U.S. PATENT DOCUMENTS

2010/0004766 A1* 1/2010 Feng ..... G10H 1/46 700/94
2016/0261961 A1 9/2016 Anderson
(Continued)

OTHER PUBLICATIONS

Anzalone, M. C., Calandruccio, L., Doherty, K. A., and Carney, L. H. (2006). "Determination of the potential benefit of time-frequency gain manipulation," Ear Hear. 27, 480-492.
(Continued)

*Primary Examiner* — Paul Kim
(74) *Attorney, Agent, or Firm* — Meunier Carlin & Curfman LLC

(57) ABSTRACT

Auditory communication devices and related methods are described herein. An example auditory communication device can include a microphone configured to collect acoustic energy and convert the collected acoustic energy into an audio signal, a processor operably coupled to the microphone, and a memory operably coupled to the processor. The processor can be configured to receive the audio signal from the microphone, create a time-frequency (T-F) representation of the audio signal, classify each of a plurality of T-F units into one of N discrete categories, and attenuate the T-F representation of the audio signal. A respective level of attenuation for each of the T-F units is determined by its respective classification. The processor can be further configured to create a synthesized signal from the attenuated T-F representation of the audio signal.

15 Claims, 14 Drawing Sheets

(51) Int. Cl.
*G10L 21/0232* (2013.01)
*G10L 25/30* (2013.01)

(58) Field of Classification Search
USPC ..... 381/73.1
See application file for complete search history.

(56) References Cited

U.S. PATENT DOCUMENTS

2017/0004841 A1 1/2017 Jensen
2017/0078806 A1 3/2017 Hui et al.

OTHER PUBLICATIONS

Brons, I., Houben, R., and Dreschler, W. A. (2012). "Perceptual effects of noise reduction by time-frequency masking of noisy speech," J. Acoust. Soc. Am. 132, 2690-2699.
Brungart, D. S., Chang, P. S., Simpson, B. D., and Wang, D. L. (2006). "Isolating the energetic component of speech-on-speech masking with ideal time-frequency segregation," J. Acoust. Soc. Am. 120, 4007-4018.
Chen J., Wang Y., Yoho, S. E., Wang, D. L., and Healy, E.W. (2016). "Large-scale training to increase speech intelligibility for hearing-impaired listeners in novel noises," J. Acoust. Soc. Am. 139, 2604-2612.
Dillon, H. (2012). Hearing Aids, 2nd Ed. (Boomerang, Turramurra, Australia), p. 232.
Healy, E.W., Delfarah, M., Carter, B. L., Vasko, J. L., and Wang, D. L. (2017). "An algorithm to increase intelligibility for hearing-impaired listeners in the presence of a competing talker," J. Acoust. Soc. Am. 141, 4230-4239.
Healy, E. W., Yoho, S. E., Chen, J., Wang, Y., and Wang, D. L. (2015). "An algorithm to increase speech intelligibility for hearing-impaired listeners in novel segments of the same noise type," J. Acoust. Soc. Am. 138, 1660-1669.
Healy, E. W., Yoho, S. E., Wang, Y., Apoux, F., and Wang, D. L. (2014). "Speech-cue transmission by an algorithm to increase consonant recognition in noise for hearing-impaired listeners," J. Acoust. Soc. Am. 136, 3325-3336.
Healy, E. W., Yoho, S. E., Wang, Y., and Wang, D. L. (2013). "An algorithm to improve speech recognition in noise for hearing-impaired listeners," J. Acoust. Soc. Am. 134, 3029-3038.
Hirsh, I. J., Davis, H., Silverman, S. R., Reynolds, E. G., Eldert, E., and Benson, R. W. (1952). "Development of materials for speech audiometry," J. Speech Hear. Disord. 17, 321-337.
Hu, G. and Wang, D. L. (2001). "Speech segregation based on pitch tracking and amplitude modulation," in Proceedings of IEEE Workshop on Applications of Signal Processing to Audio and Acoustics, pp. 79-82.
Hummersone, C., Stokes, T., and Brooks, T. (2014). "On the ideal ratio mask as the goal of computational auditory scene analysis," in Blind Source Separation, edited by G.R. Naik and W. Wang (Springer, Berlin), pp. 349-368.
Kim, G., Lu, Y., Hu, Y., and Loizou, P. C. (2009). "An algorithm that improves speech intelligibility in noise for normal-hearing listeners," J. Acoust. Soc. Am. 126, 1486-1494.
Kjems, U., Boldt, J. B., Pedersen, M. S., Lunner, T., and Wang, D. L. (2009). "Role of mask pattern in intelligibility of ideal binary-masked noisy speech," J. Acoust. Soc. Am. 126, 1415-1426.
Koning, R., Madhu, N., and Wouters, J. (2015). "Ideal time-frequency masking algorithms lead to different speech intelligibility and quality in normal-hearing and cochlear implant listeners," IEEE Transactions on Biomedical Engineering, 62, 331-341.
Li, N. and Loizou, P. C. (2008a). "Effect of spectral resolution on the intelligibility of ideal binary masked speech," J. Acoust. Soc. Am. 123, EL59-EL64.
Li, N. and Loizou, P.C. (2008b). "Factors influencing intelligibility of ideal binary-masked speech: Implications for noise reduction," J. Acoust. Soc. Am. 123, 1673-1682.
Li, Y. and Wang, D. L. (2009). "On the optimality of ideal binary time-frequency masks," Speech Comm. 51, 230-239.
Madhu, N., Spriet, A., Jansen, S., Koning, R., and Wouters, J. (2013). "The potential for speech intelligibility improvement using the ideal binary mask and the ideal Wiener filter in single channel noise reduction systems: Application to auditory prostheses," IEEE Transactions on Audio, Speech, and Language Processing, 21, 63-72.
Monaghan, J. J. M., Goehring, T., Yang, X., Bolner, F., Wang, S., Wright, M. C. M., and Bleeck, S. (2017). "Auditory inspired machine learning techniques can improve speech intelligibility and quality for hearing-impaired listeners," J. Acoust. Soc. Am. 141, 1985-1998.
Narayanan, A. and Wang, D. L. (2013). "Ideal ratio mask estimation using deep neural networks for robust speech recognition," IEEE International Conference on Acoustics, Speech, and Signal Processing. Proceedings, 7092-7096.
Rix, A., Beerends, J., Hollier, M., and Hekstra, A. (2001). "Perceptual evaluation of speech quality (PESQ)—a new method for speech quality assessment of telephone networks and codecs," IEEE International Conference on Acoustics, Speech, and Signal Processing. Proceedings, 749-752.
Sinex, D. G. (2013). "Recognition of speech in noise after application of time-frequency masks: Dependence on frequency and threshold parameters," J. Acoust. Soc. Am. 133, 2390-2396.
Spahr, A. J., Dorman, M. F., Litvak, L. M., Van Wie, S., Gifford, R. H., Loizou, P. C., Loiselle, L. M., Oakes, T., and Cook, S. (2012). "Development and validation of the AzBio sentence lists," Ear Hear. 33,112-117.
Srinivasan, S., Roman, N., and Wang, D. L. (2006). "Binary and ratio time-frequency masks for robust speech recognition," Speech Comm. 48, 1486-1501.
Taal, C. H., Hendriks, R. C., Heusdens, R., and Jensen, J. (2011). "An algorithm for intelligibility prediction of time-frequency weighted noisy speech," IEEE Trans. Audio Speech Lang. Proc. 19, 2125-2136.
Wang, D. L. (2005). "On ideal binary mask as the computational goal of auditory scene analysis," In Speech separation by humans and machines, P. Divenyi, ed., pp. 181-197. Norwell MA: Kluwer Academic.
Wang, D. L. (2008). "Time-frequency masking for speech separation and its potential for hearing aid design," Trends in Amplification, 12, 332-353.
Wang, D. L. and Brown, G., eds. (2006). Computational Auditory Scene Analysis: Chapter 1 Fundamentals of Computational Auditory Scene Analysis (Wiley-IEEE Press, Hoboken, NJ) pp. 1-44.
Wang, D. L., Kjems, U., Pedersen, M., Boldt, J., and Lunner, T. (2009). "Speech intelligibility in background noise with ideal binary time-frequency masking," J. Acoust. Soc. Am. 125, 2336-2347.
Wang, Y., Narayanan, A., and Wang, D. L. (2014). "On training targets for supervised speech separation," IEEE/ACM Trans. Audio Speech Lang. Proc. 22, 1849-1858.
Williamson, D. S., Wang, Y., and Wang, D. L. (2015). "Estimating nonnegative matrix model activations with deep neural networks to increase perceptual speech quality," J. Acoust. Soc. Am. 138, 1399-1407.
International Search Report and Written Opinion issued by the International Searching Authority (ISA/US) in PCT Application No. PCT/US2019/032631 dated Jul. 25, 2019. 10 pages.

* cited by examiner

*FIG. 1A*
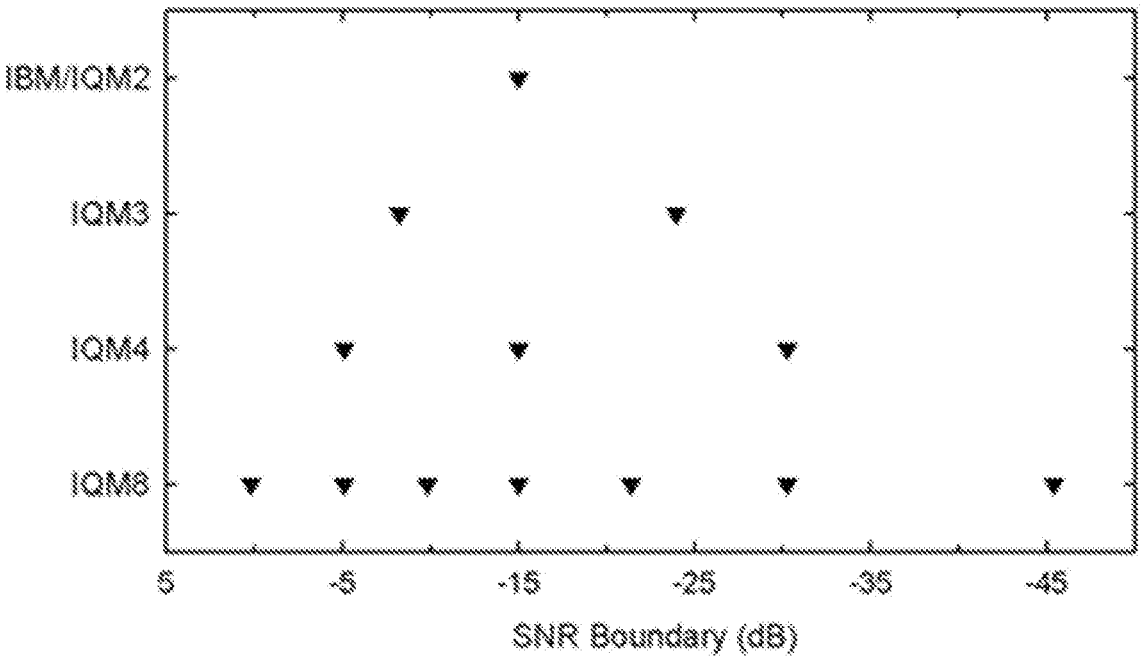
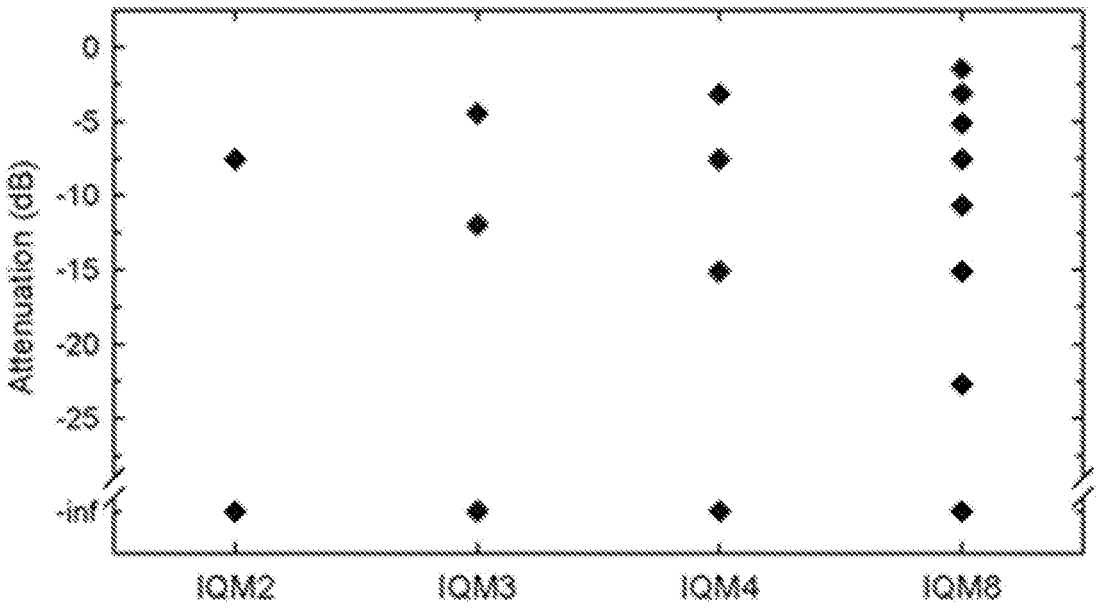
*FIG. 1B*

AUDITORY COMMUNICATION DEVICES AND RELATED METHODS

CROSS-REFERENCE TO RELATED APPLICATIONS

This application is a national stage application filed under 35 U.S.C. § 371 of PCT/US2019/032631 filed on May 16, 2019, which claims the benefit of U.S. provisional patent application No. 62/672,118, filed on May 16, 2018, and entitled "AUDITORY COMMUNICATION DEVICES AND RELATED METHODS," the disclosures of which are expressly incorporated herein by reference in their entireties.

STATEMENT REGARDING FEDERALLY FUNDED RESEARCH

This invention was made with government support under R01 DC015521 awarded by the National Institutes of Health. The government has certain rights in the invention.

BACKGROUND

The perception of speech in background noise represents a challenge for a variety of listeners in a variety of settings. Normal-hearing (NH) listeners with proficiency of the language can tolerate considerable amounts of noise if conditions are otherwise ideal. But even these best listeners can struggle if the signal is acoustically deficient, as can be the case during transmission over cellular phones, traditional telephones, radios, or other communication systems. The situation is compounded if the listener does not have complete proficiency with the language, as is the case for non-native listeners, children, and other individuals. But the challenge is particularly striking for listeners with hearing loss. In fact, poor speech recognition when background noise is present is a primary auditory complaint of hearing-impaired (HI) individuals (see Moore, 2007; Dillon, 2012), and the speech-in-noise problem for these listeners represents one of our greatest challenges.

Fortunately, techniques exist to help alleviate this challenge. Time-frequency (T-F) masking represents a powerful tool for improving the intelligibility of speech in noise. In T-F masking, the speech-plus-noise mixture is divided in both time and frequency into small units, and each T-F unit is scaled in level according to the relationship between the speech and the noise within the unit. Units with less favorable signal-to-noise ratios (SNRs) are attenuated, resulting in a signal containing T-F units largely dominated by the target speech signal. It is important to note that, in T-F masking, no attempt is made to segregate the speech from the noise at any given time or frequency. Instead, the more favorable portions of the speech-plus-noise mixture are passed along to the listener.

There are two classes of T-F masks, known as "hard" and "soft" masks. These correspond to two main T-F masking schemes, which include binary masking and ratio masking. In the Ideal Binary Mask (IBM; Hu and Wang, 2001; Wang, 2005), each T-F unit is assigned a value of 1 if it is dominated by the target speech or 0 if it is dominated by noise. The IBM is then multiplied with the speech-plus-noise mixture, causing units dominated by the noise to be discarded and units dominated by the target speech to remain intact. In the Ideal Ratio Mask (IRM; Srinivasan et al., 2006; Narayanan and Wang, 2013; Hummerstone et al., 2014; Wang et al., 2014), each T-F unit is again assigned an attenuation scaling according to the speech versus noise relationship. But rather than a binary decision, this scaling can take any value along a continuum from 0 to 1. Units having a more favorable SNR are attenuated less and those having a less favorable SNR are attenuated more. Accordingly, the IRM is similar to the classic Wiener filter (see Loizou, 2007). As with the IBM, the speech-plus-noise mixture is multiplied with this mask to obtain an array of T-F units, each scaled according to its speech versus noise dominance.

Both masks can produce vast improvements in the intelligibility of noisy speech. Brungart et al. (2006), Li and Loizou (2008a; 2008b), Kim et al. (2009), Kjems et al. (2009), and Sinex (2013) all found that the IBM could produce near-perfect sentence intelligibility for NH listeners in various noises (speech-shaped noise, speech-modulated noise, 2- to 20-talker babble, and various recorded environmental sounds). Anzalone et al. (2006) and Wang et al. (2009) tested both NH and HI subjects and found that the IBM could produce substantial speech-reception threshold (SRT) improvements for sentences in various noises (speech-shaped noise and cafeteria noise). With regard to the IRM, Madhu et al. (2013) and Koning et al. (2015) found that it can also produce near-perfect sentence intelligibility for NH listeners in various noises (multi-talker babble and single-talker interference).

The comparison between intelligibility produced by the IBM versus that produced by the IRM is made difficult by the fact that all of the studies cited above employed sentence materials and those employing percent-correct intelligibility often observed ceiling scores at or near 100%. But Madhu et al. (2013) and Koning et al. (2015) both observed that the IRM produced ceiling intelligibility for NH subjects over a wider range of parameter values than did the IBM. In contrast, Brons et al. (2012) observed that the IBM led to better intelligibility than did an IRM in which negative SNR values were assigned a fixed attenuation of 10 dB. Thus, the relative intelligibilities produced by the IBM versus the IRM are not clear. What is more clear is that soft masking typically offers better speech-sound quality than hard masking. Madhu et al. (2013) conducted pairwise comparisons of preferred sound quality for NH subjects and found that the ideal Weiner filter was preferred over the IBM in 88% to 100% of trials.

The term "ideal" in "ideal binary masking" and "ideal ratio masking" refers to the fact that the masks are created using knowledge of the pre-mixed target speech and noise signals, i.e., they are oracle masks. The term also refers to the fact that the IBM produces the optimal SNR gain of all binary T-F masks under certain conditions (Li and Wang, 2009). Obviously, knowledge of the pre-mixed signals is not present in real-world settings. But translational significance for T-F masks comes from efforts to estimate them directly from the speech-noise mixture, and the IBM has for many years been considered a goal of computational auditory scene analysis (Wang, 2005). Recent advances in machine learning have allowed both the IBM and the IRM to be estimated with accuracy sufficient to produce considerable intelligibility improvements. This work has involved both NH listeners (Kim et al., 2009; Healy et al., 2013; Healy et al., 2014; Healy et al., 2015; Chen et al., 2016; Healy et al., 2017; Monaghan et al., 2017) and HI listeners (Healy et al., 2013; Healy et al., 2014; Healy et al., 2015; Chen et al., 2016; Healy et al., 2017; Monaghan et al., 2017) in a variety of background noises (speech-shaped noise, multi-talker babble, recorded environmental sounds, and single-talker interference). The resulting intelligibility improvements have often allowed HI subjects having access to the T-F masked speech to equal the performance of young NH subjects without processing.

In addition to their different perceptual ramifications, the two main T-F masking schemes possess different characteristics that may be relevant for their estimation by machine-learning algorithms. Estimation of the IBM involves classification, whereas estimation of the IRM typically involves regression and approximation of an underlying function. These represent very different learning tasks, and it has been argued that computation of a binary mask may be considerably simpler than computation of a soft mask (Wang, 2008). It has also been argued (e.g., Wang et al., 2014) and observed (Madhu et al., 2013; Koning et al., 2015) that soft masks are more robust to estimation errors relative to binary masks. This is because errors are likely smaller in attenuation magnitude in the former than in the latter.

SUMMARY

An example auditory communication device is described herein. The auditory communication device can include a microphone configured to collect acoustic energy and convert the collected acoustic energy into an audio signal, a processor operably coupled to the microphone, and a memory operably coupled to the processor. The processor can be configured to receive the audio signal from the microphone, and create a time-frequency (T-F) representation of the audio signal, where the T-F representation of the audio signal includes a plurality of T-F units. The processor can also be configured to classify each of the T-F units into one of N discrete categories, where N is an integer greater than 2, and attenuate the T-F representation of the audio signal, where a respective level of attenuation for each of the T-F units is determined by its respective classification. The processor can be further configured to create a synthesized signal from the attenuated T-F representation of the audio signal.

In some implementations, N is greater than or equal to 4. In some implementations, N is less than or equal to 8.

Alternatively or additionally, each of the N discrete categories can be associated with a different level of attenuation.

Alternatively or additionally, each of the T-F units can be classified into one of N discrete categories based on its signal-to-noise ratio (SNR). In some implementations, the N discrete categories can be created based on an ideal ratio mask (IRM) function. Alternatively or additionally, the respective levels of attenuation corresponding to each of the N discrete categories can be based on the IRM function.

Alternatively or additionally, each of the T-F units can be classified into one of N discrete categories using a machine-learning algorithm. Optionally, the machine-learning algorithm can be a neural network. Optionally, the neural network can be a deep neural network (DNN), a recurrent neural network (RNN), a convolutional neural network (CNN), a perceptron, a long-short term memory (LSTM), a gated recurrent unit (GRU), a Hopfield network (HN), a Boltzmann machine, a deep belief network, an autoencoder, a generative adversarial network (GAN), a bitwise neural network, or a binarized neural network.

Alternatively or additionally, the auditory communication device can include a receiver operably coupled to the processor, where the receiver can be configured to convert the synthesized signal into acoustic energy.

Alternatively or additionally, in some implementations, the auditory communication device includes a single microphone.

Alternatively or additionally, the audio signal can include a target signal and noise.

Alternatively or additionally, the synthesized signal can improve detection or understandability of the audio signal. Optionally, a signal-to-noise ratio (SNR) of the synthesized signal can be greater than a SNR of the audio signal.

Alternatively or additionally, the auditory communication device can be a hearing aid, cochlear implant, telephone, public address system, headset communication device, vehicle communication device, military communication device, aviation communication device, two-way radio, or walkie-talkie.

An example monaural auditory processing method is described herein. The method can include receiving acoustic energy and converting the acoustic energy into an audio signal using a microphone. The method can also include receiving the audio signal from the microphone, and creating a time-frequency (T-F) representation of the audio signal, where the T-F representation of the audio signal includes a plurality of T-F units. The method can further include classifying each of the T-F units into one of N discrete categories (e.g., where N is an integer greater than 2), attenuating the T-F representation of the audio signal, and creating a synthesized signal from the attenuated T-F representation of the audio signal. The respective level of attenuation for each of the T-F units can be determined by its respective classification.

An example computer-implemented auditory processing method is also described herein. The method can include receiving an audio signal, and creating a time-frequency (T-F) representation of the audio signal, where the T-F representation of the audio signal includes a plurality of T-F units. The method can also include classifying each of the T-F units into one of N discrete categories (e.g., where N is an integer greater than 2), attenuating the T-F representation of the audio signal, and creating a synthesized signal from the attenuated T-F representation of the audio signal. The respective level of attenuation for each of the T-F units can be determined by its respective classification.

It should be understood that the above-described subject matter may also be implemented as a computer-controlled apparatus, a computer process, a computing system, or an article of manufacture, such as a computer-readable storage medium.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale relative to each other. Like reference numerals designate corresponding parts throughout the several views.

FIG. 1A displays the SNR boundaries for each step of each example ideal quantized mask (IQM) employed (top panel, FIG. 1A). FIG. 1B displays the attenuations produced by each step of each example IQM employed (bottom panel, FIG. 1B).

displays scores for broadband signals and the bottom panel (FIG. 1D) displays scores for a different group of normal-hearing subjects who heard the same signals filtered from 750 to 3000 Hz in order to avoid ceiling recognition values.

Figures 2A, 2B:
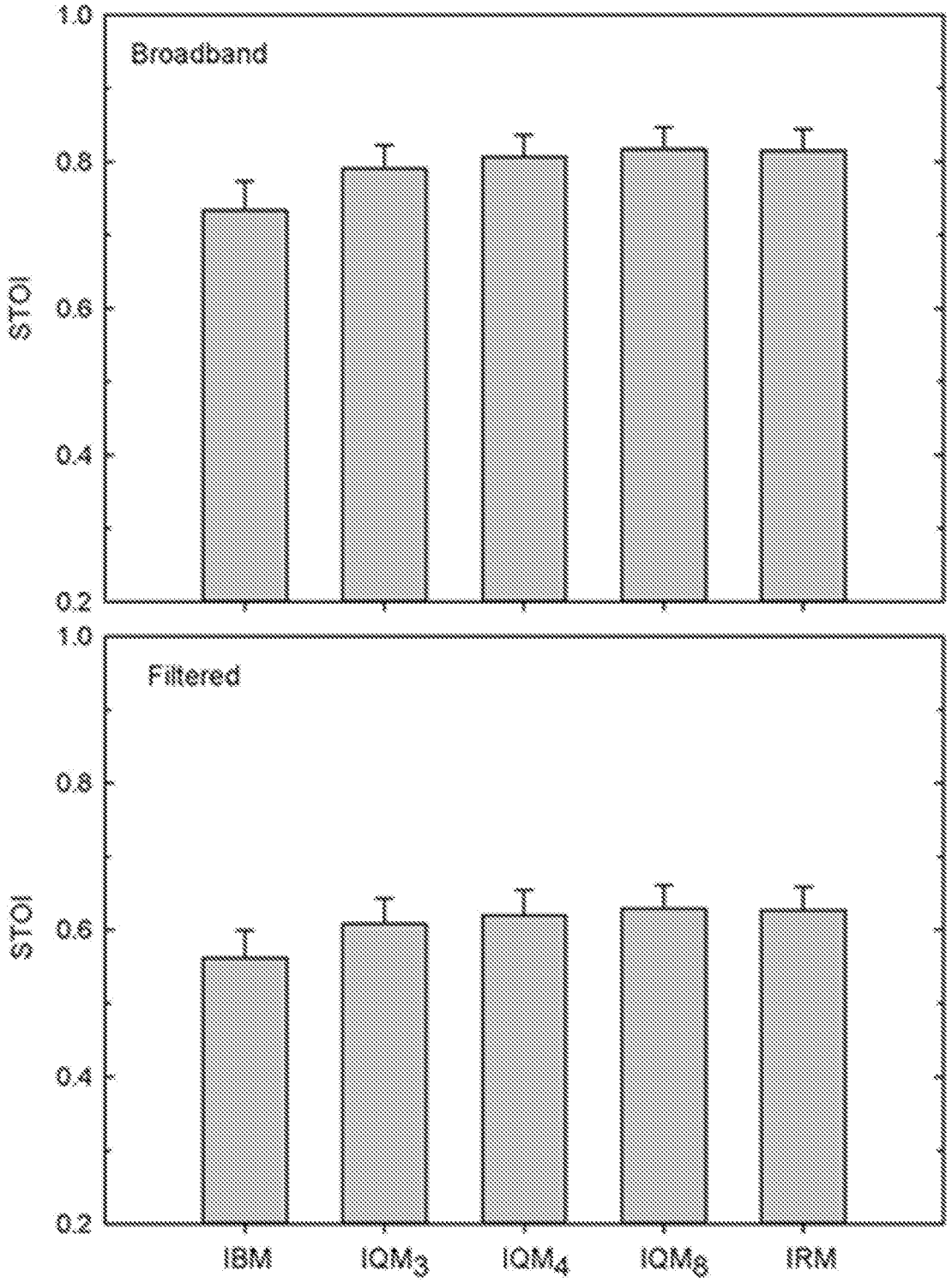

FIGS. 2A and 2B illustrate short-time objective intelligibility predictions (STOI) based on the broadband acoustic stimuli employed in Ex. 1a (top panel, FIG. 2A) and the filtered stimuli employed in Ex. 1b (bottom panel, FIG. 2B). For each condition, STOI values were calculated for each W-22 utterance separately, then averaged. Errors represent standard deviations.

Figure 3:
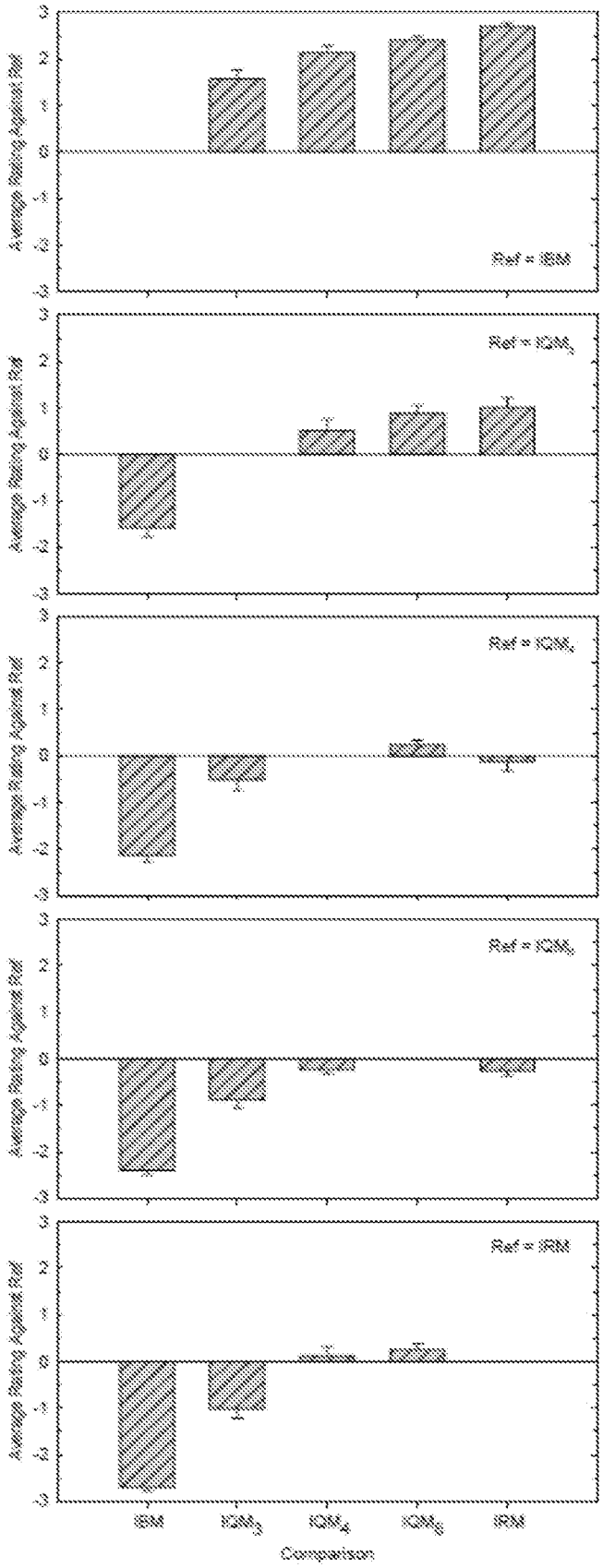

FIG. 3 illustrates sound-quality ratings from normal-hearing subjects for the various time-frequency masks. Masks were presented in pairs and subjects rated which was preferred and by how much on a 7-point scale. 0 indicates no preference, 1 indicates "slight preference," 2 indicates "moderate preference," and 3 indicates "strong preference." Each panel displays group mean (and standard error) ratings for each mask when compared against a given reference mask. Positive values indicate a preference for the comparison mask, and negative values indicate a lack of preference for the comparison mask (a preference for the reference).

Figure 4:
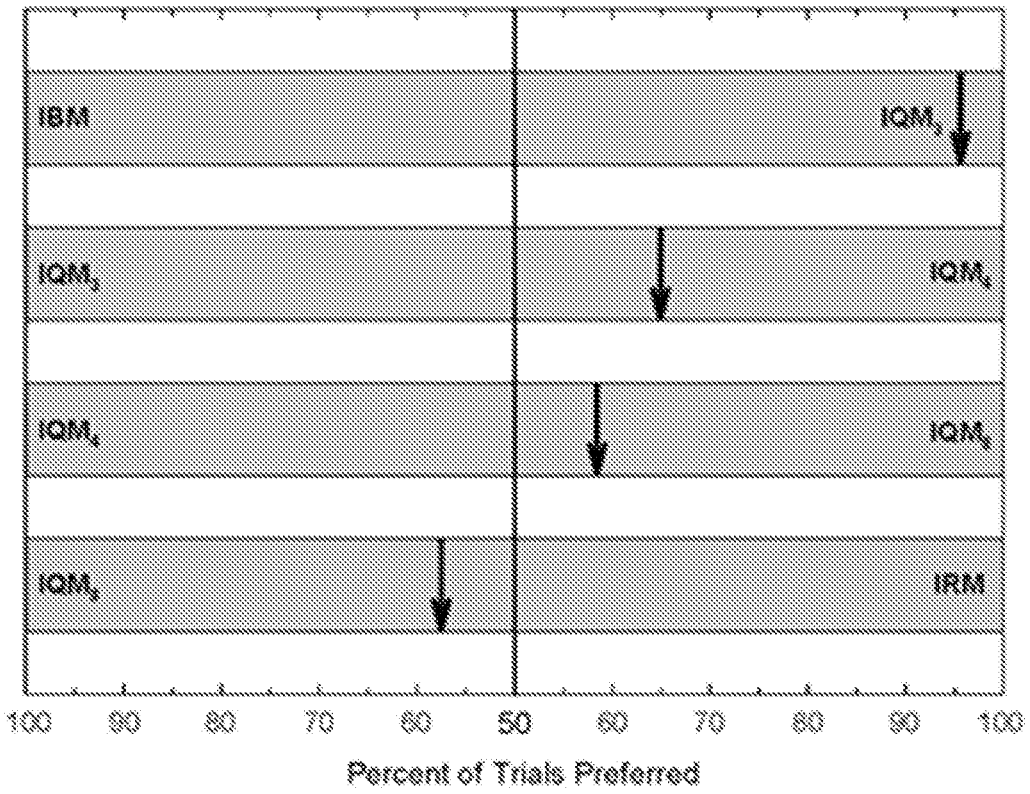

FIG. 4 illustrates percentage of trials in which sound-quality was preferred for one mask over another. Data are from normal-hearing subjects. The comparisons shown are for masks that are adjacent along the attenuation-step continuum. 50% reflects no preference.

Figure 5:
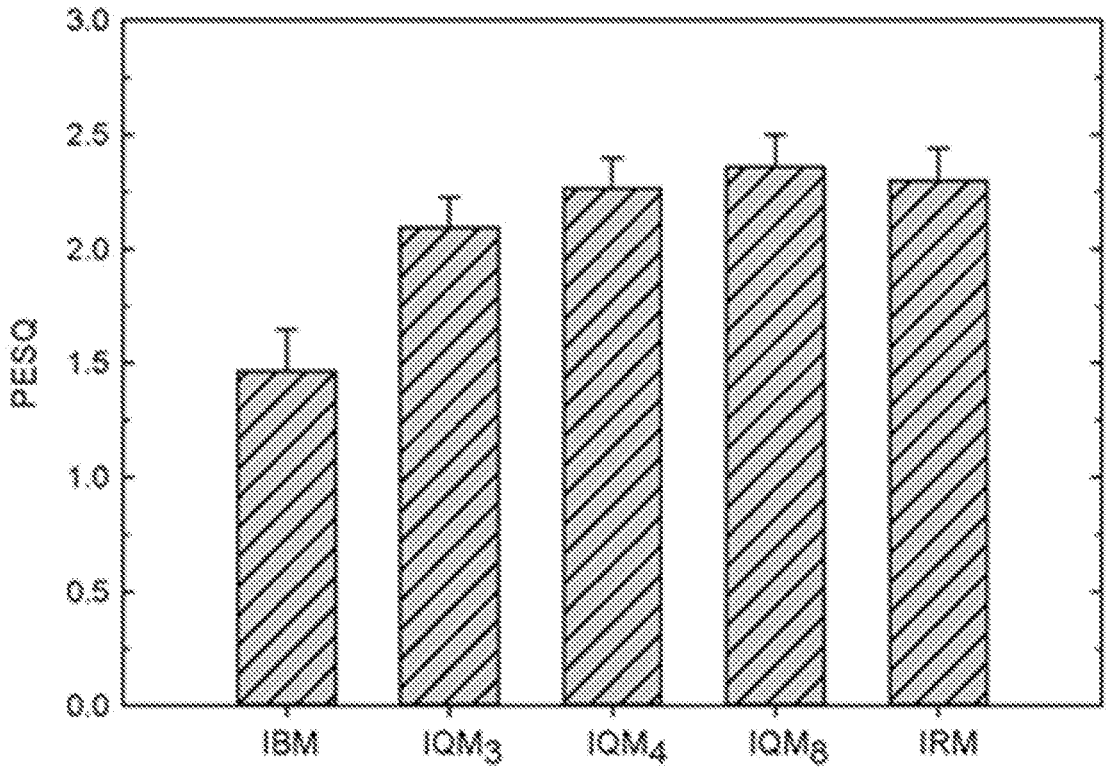
Figure 6A:
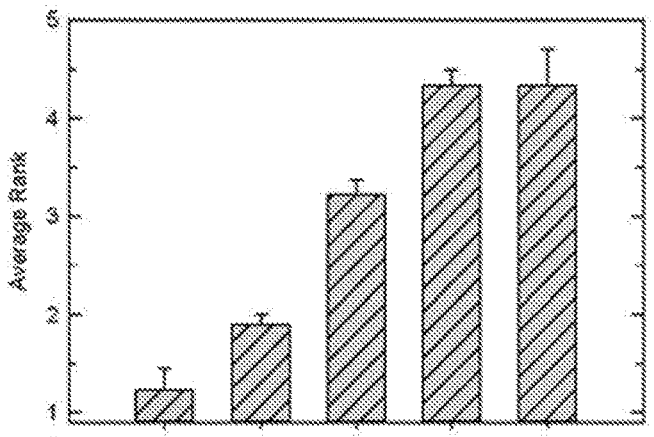
Figure 6B:
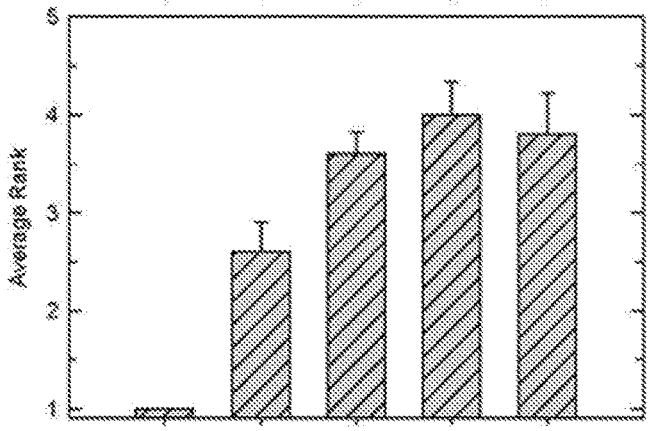
Figure 6C:
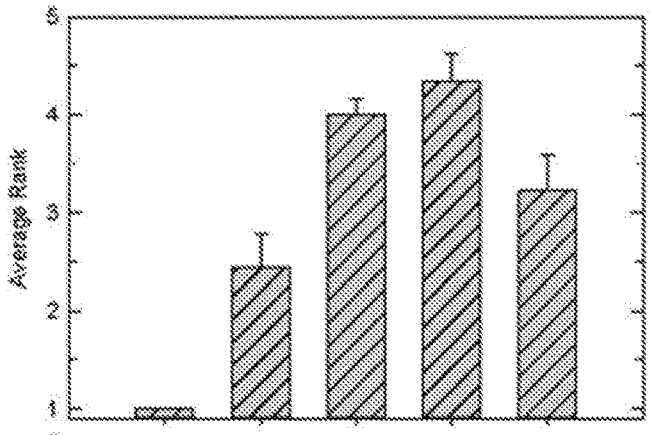
Figure 6D:
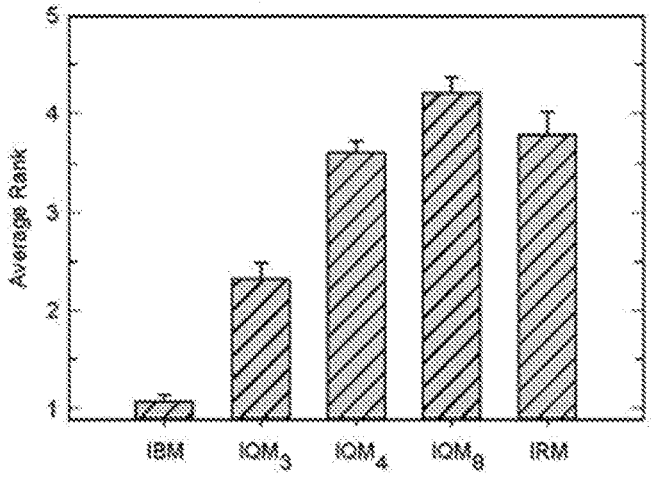

FIG. 5 illustrates Perceptual Evaluation of Speech Quality (PESQ) estimates of sound quality based on the acoustic stimuli employed in Ex. 2a. Shown are means and standard deviations for Central Institute for the Deaf (CID) sentences mixed with cafeteria noise and processed by the five time-frequency masks.

FIGS. 6A-6D illustrate group mean subjective sound-quality rankings (and standard errors) by the normal-hearing subjects for the five time-frequency masks. A ranking of 1 indicates that the sound quality was least preferred and a ranking of 5 indicates that the sound quality was most preferred. Panels A-C (FIGS. 6A-6C) represent rankings produced by subjects involved in Exs. 1a, 1b, and 2a, respectively. Panel D (FIG. 6D) displays the mean across these subgroups.

Figures 7A, 7B:
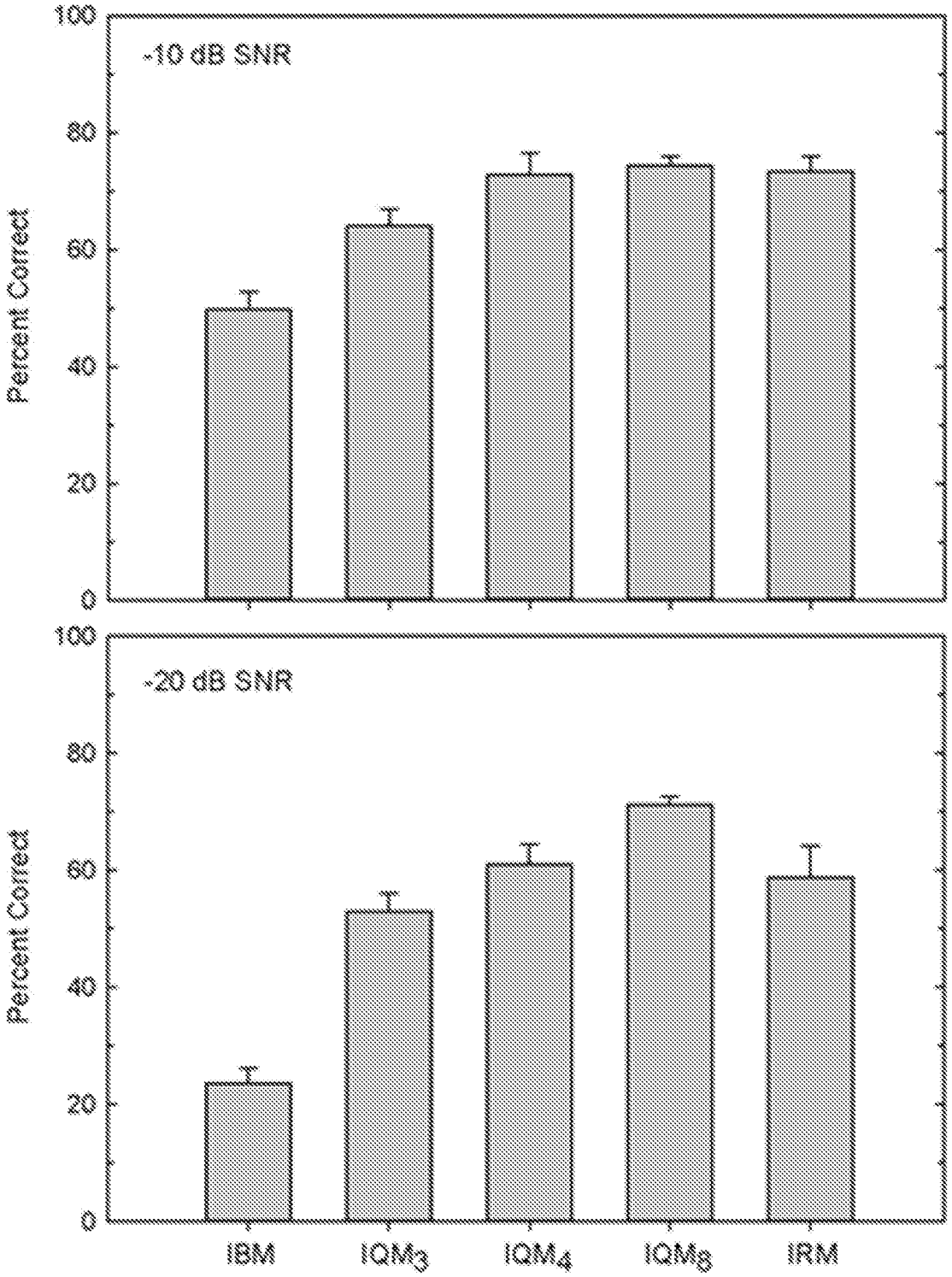

FIGS. 7A and 7B illustrate group mean W-22 word recognition (and standard errors) for normal-hearing listeners hearing speech in a single-talker background at SNRs of −10 dB (top panel, FIG. 7A) and −20 dB (bottom panel, FIG. 7B), after processing by five different time-frequency masks. Stimuli were filtered from 750 to 3000 Hz in order to avoid ceiling recognition values.

Figure 8:
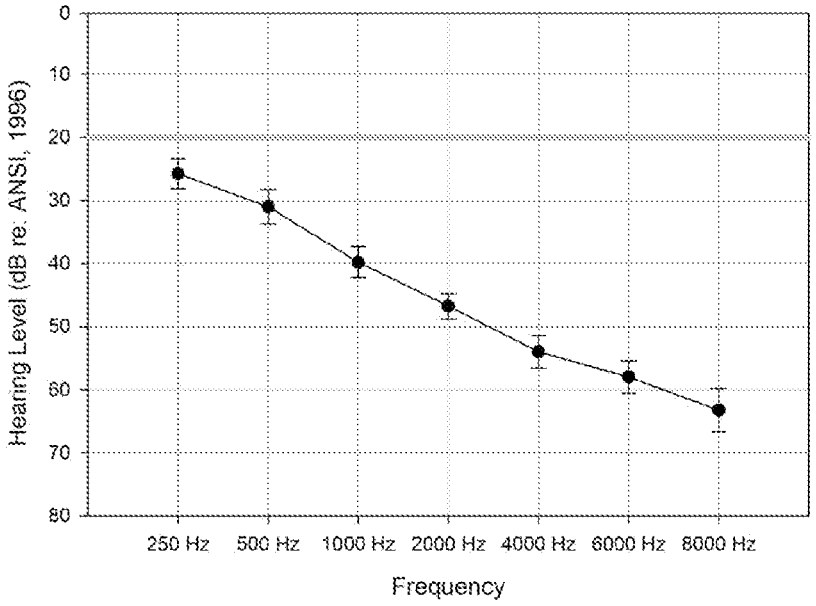

FIG. 8 illustrates average audiograms (and standard errors) describing the hearing loss of 10 hearing-impaired subjects used in Ex. 5. The normal-hearing threshold of 20 dB Hearing Level is indicated by the shaded horizontal line, and values below this line indicate hearing loss.

Figure 9:
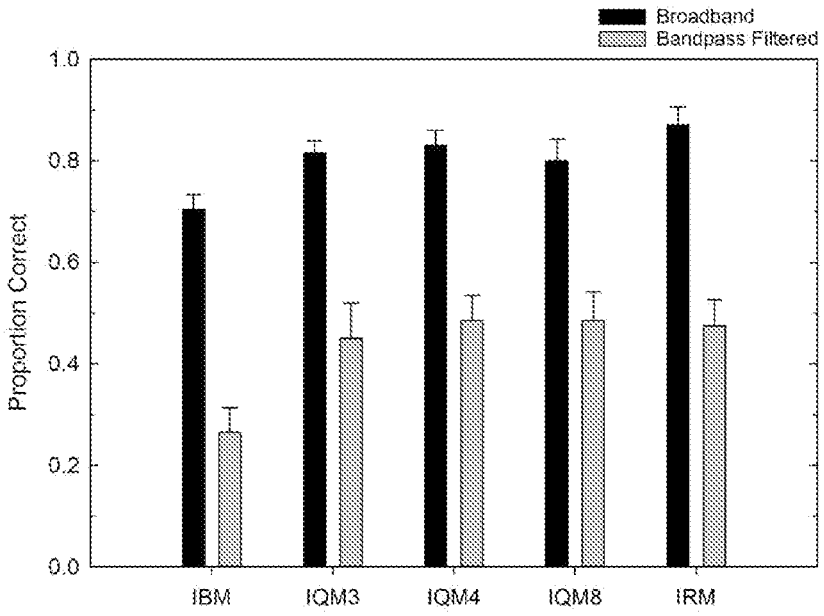

FIG. 9 illustrates group mean W-22 word recognition (and standard errors) for hearing-impaired listeners in Ex. 5 hearing speech in cafeteria noise, processed by five different time-frequency masks. The black columns displays scores for broadband signals, and the grey columns displays scores for the same subjects who heard the same signals filtered from 750 to 3000 Hz in order to avoid ceiling recognition values.

Figure 10:
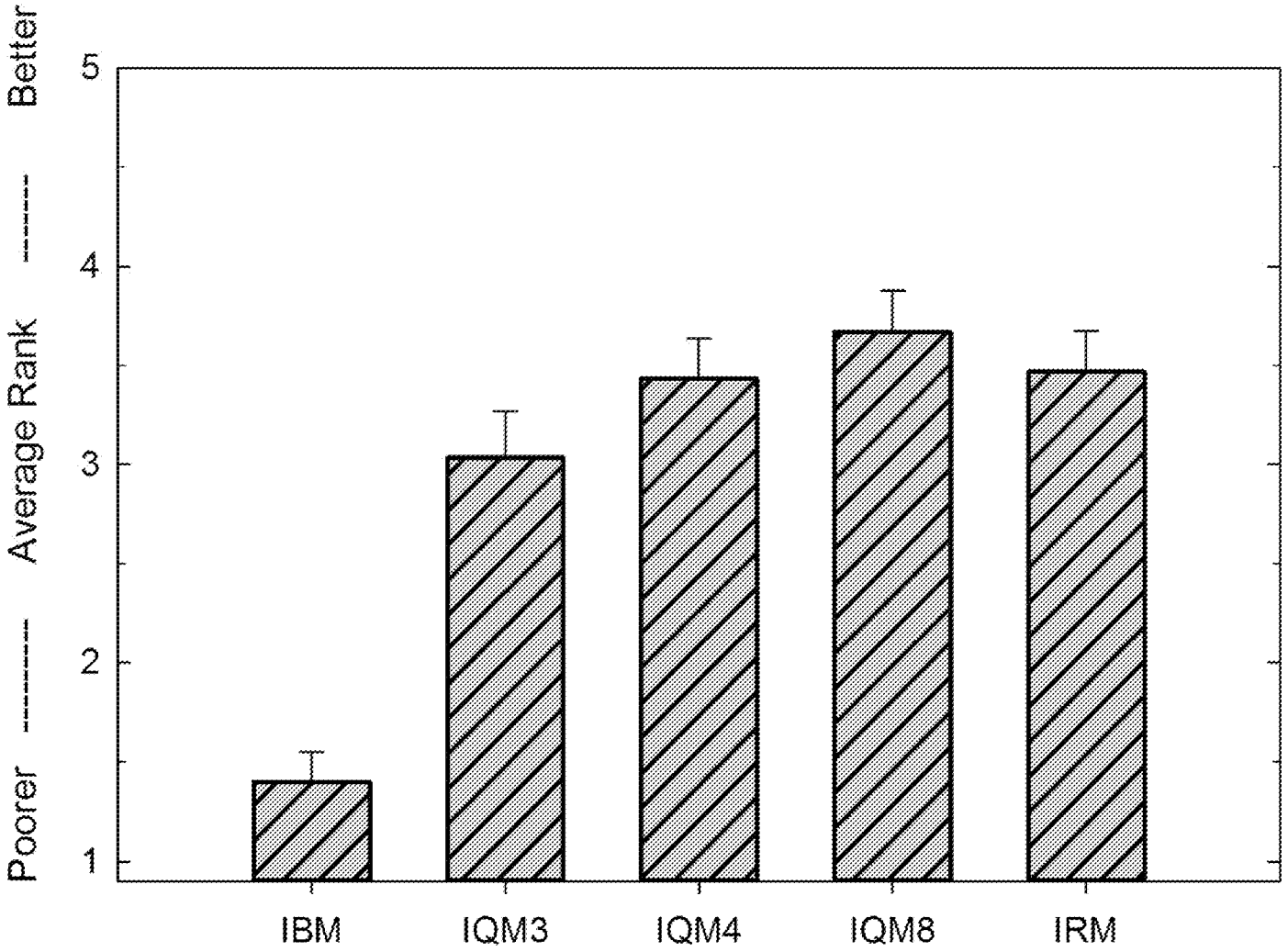

FIG. 10 illustrates group mean subjective sound-quality rankings (and standard errors) from the hearing-impaired subjects in Ex. 5 for the five time-frequency masks. A ranking of 1 indicates that the sound quality was least preferred and a ranking of 5 indicates that the sound quality was most preferred.

Figure 11A:
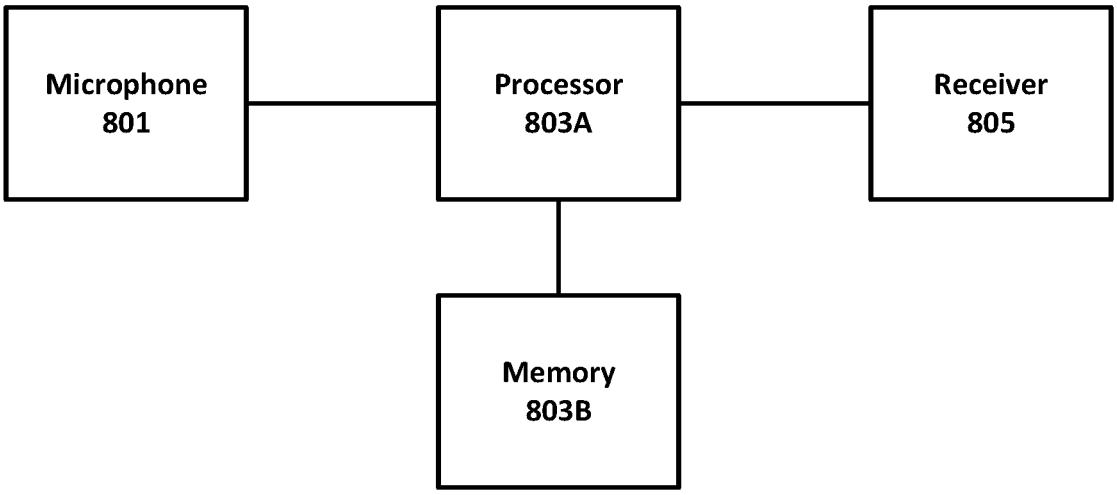
Figure 11B:
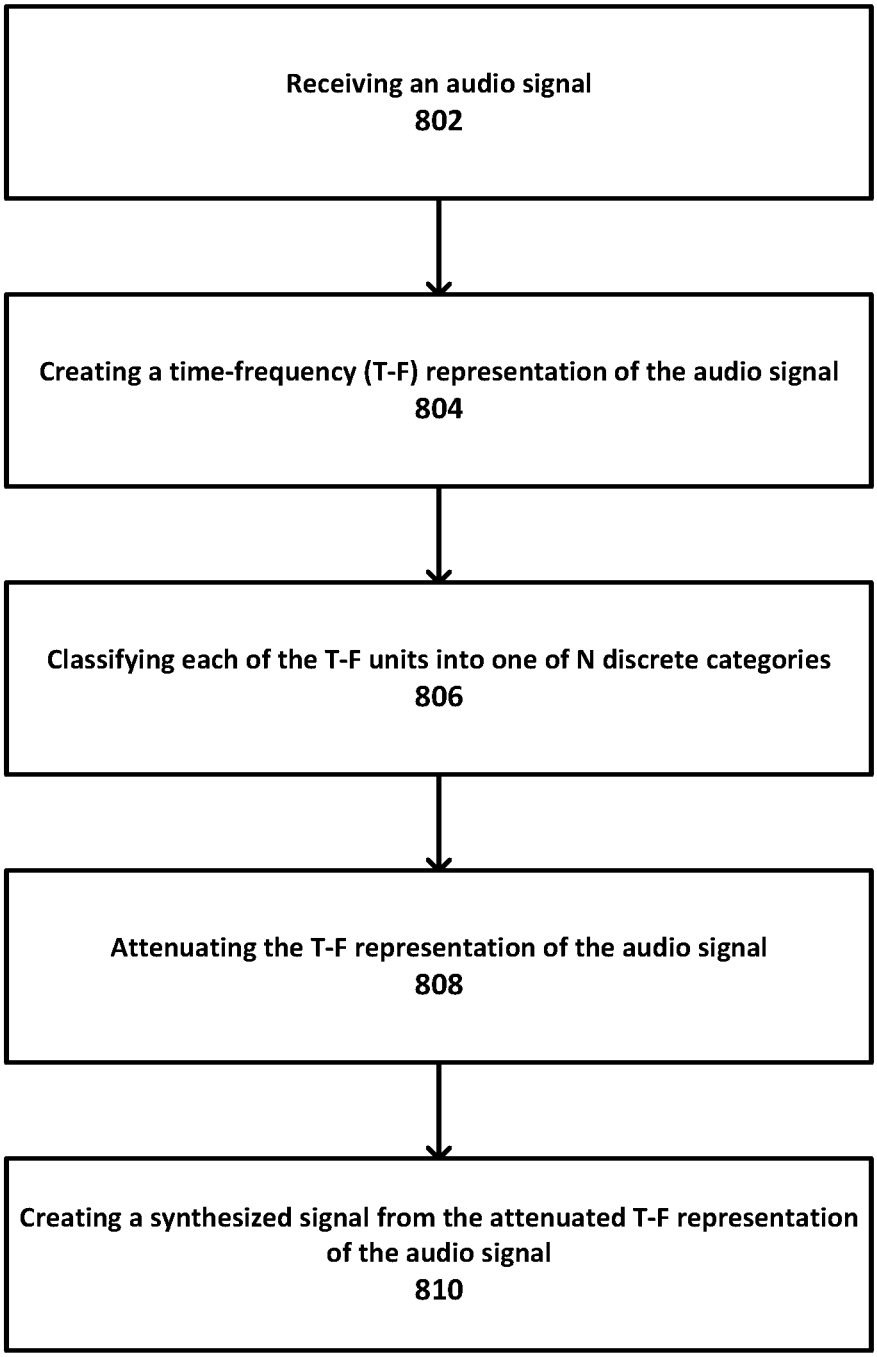

FIG. 11A is a block diagram illustrating an example auditory communication device according to an implementation described herein. FIG. 11B is a flow diagram illustrating example operations for an auditory processing method according to an implementation described herein.

Figure 12:
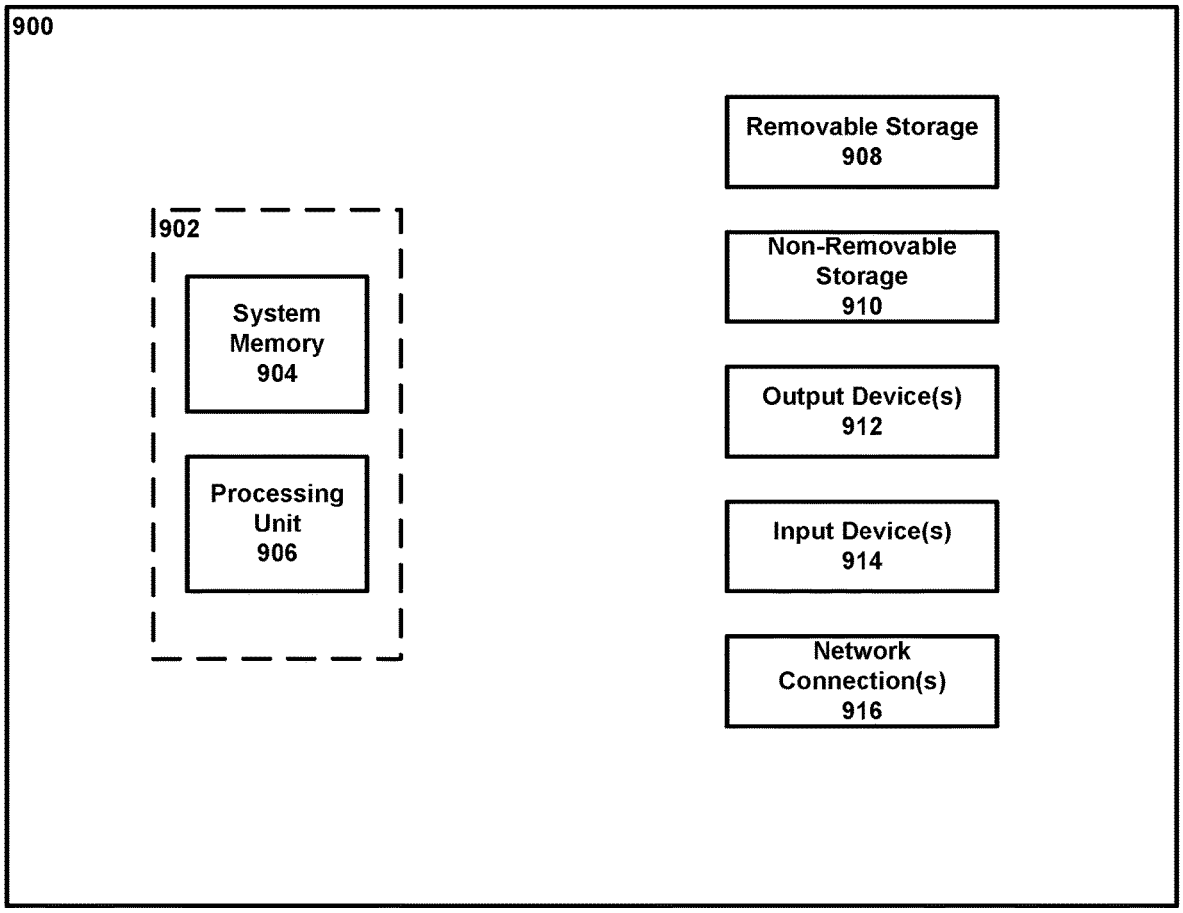

FIG. 12 is an example computing device.

DETAILED DESCRIPTION

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. While implementations will be described for using an ideal quantized mask (IQM) to increase the intelligibility and/or quality of speech in noise, it will become evident to those skilled in the art that the implementations are not limited thereto.

Time-frequency masking represents a powerful tool to increase the intelligibility and/or quality of speech in background noise. And the accurate estimation of time-frequency masks by machine-learning algorithms provides translational relevance. In the examples described below, a technique using an ideal quantized mask (IQM) is described. In the IQM, speech and noise are partitioned into time-frequency units, and each unit receives one of N predetermined attenuations according to its signal-to-noise ratio. It was found that as few as four to eight attenuation steps ($IQM_4$, $IQM_8$) provided significant increases in intelligibility over the ideal binary mask (IBM, having 2 attenuation steps), and equaled the intelligibility resulting from the ideal ratio mask (IRM, having a theoretically infinite number of steps). Sound-quality ratings and rankings of noisy speech processed by the $IQM_4$ and $IQM_8$ were found to be superior to that processed by the IBM and to equal or exceed that processed by the IRM. It is concluded that the intelligibility and sound-quality advantages infinite attenuation resolution can be captured by an IQM having only a very small number of steps. Further, estimation of the IQM involves classification of T-F units (into N categories), which can provide algorithmic advantages over regression-based IRM estimation.

In the examples below, a mask (i.e., ideal quantized mask (IQM)) is described that is different from the two main classes or schemes of T-F masking (i.e., ideal binary mask (IBM) and ideal ratio mask (IRM)). IQM represents an attempt to capitalize on the perceptual advantage(s) of the IRM and the computational advantages of the IBM. In the IQM, the speech-noise mixture is divided into T-F units and each is assigned an attenuation based on SNR. This attenuation takes one of N values, where N represents an integer value greater than 2. The T-F masking conditions employed in the examples below form a continuum in terms of attenuation steps, from two (IBM) to infinity (IRM). The three intermediate steps described in the examples below involve an IQM having 3, 4, and 8 steps ($IQM_3$, $IQM_4$, and $IQM_8$). It should be understood that IQM having 3, 4, and 8 steps are provided only as examples and that IQM having any number of steps greater than 2 can be used.

Example Embodiment

Referring now to FIG. 11A, a block diagram of an example auditory communication device is shown. In some implementations, the auditory communication device can be a hearing aid or cochlear implant. In other implementations, the auditory communication device can be a telephone (e.g., cellular or non-cellular telephone), a public address system, a headset communication device, a vehicle communication device, a military communication device, an aviation communication device (e.g., those used by pilots, ground crew, flight controllers, etc.), a two-way radio, or a walkie-talkie. It should be understood that the auditory communication device can be devices other than those listed above, which are provided only as examples.

The auditory communication device can include a microphone 801, a processor 803A operably coupled to the microphone 801, and a memory 803B operably coupled to the processor 803A. A microphone is a transducer that converts acoustic energy (e.g., sound) into an electrical signal (e.g., an audio signal). Microphones are well known in the art and are therefore not described in further detail below. In some implementations, the auditory communication device includes a single microphone. In other implementations, the auditory communication device includes a plurality of microphones. Optionally, the auditory communication device can include a receiver 805 operably coupled to the processor 803A, where the receiver can be configured to convert a synthesized signal (described below) into acoustic energy. The receiver can be a speaker, which converts an electrical signal (e.g., the synthesized signal) into acoustic energy (e.g., sound). Speakers are well known in the art and are therefore not described in further detail below. The synthesized signal can have better signal quality and/or signal strength as compared to the original audio signal. The microphone, processor, and/or receiver discussed above can be coupled through one or more communication links. This disclosure contemplates the communication links are any suitable communication link. For example, a communication link may be implemented by any medium that facilitates data exchange between the microphone and processor and/or the receiver and the processor including, but not limited to, wired, wireless and optical links. Example communication links include, but are not limited to, a hard-wired connection, a local area network (LAN), a wireless local area network (WLAN), a wide area network (WAN), a metropolitan area network (MAN), Ethernet, the Internet, Bluetooth, or any other wired or wireless link such as WiFi, WiMax, 3G, 4G, or 5G. This disclosure contemplates that a computing device similar to computing device 900 as shown in FIG. 12 can serve as the processor/memory.

Referring now to FIG. 11B, an example auditory processing method is shown. It should be understood that the auditory processing method can be implemented with the auditory communication device described above with regard to FIG. 11A. At step 802, an audio signal is received from a microphone (e.g., microphone 801 in FIG. 11A). As described above, the microphone collects acoustic energy (e.g., sound) and converts the collected acoustic energy into the audio signal. It should be understood that the audio signal includes a target signal and noise (e.g., mixed signal containing both a target (e.g., speech, an alarm, etc.) and background noise). The audio signal is then transmitted to and received at a computing device (e.g., including at least a processor 803A and memory 803B in FIG. 11A) for further processing. At step 804, a time-frequency (T-F) representation of the audio signal is created, where the T-F representation includes a plurality of T-F units. In other words, the audio signal is divided into a plurality of T-F units at step 804. This can optionally be accomplished using, for example, a 64-channel gammatone filterbank as described in Healy, E. W. et al., *An algorithm to improve speech recognition in noise for hearing-impaired listeners*, J. Acoust. Soc. Am., Vol. 134, No. 4, 2013, pp. 3029-3038. This technique includes passing the audio signal through the 64-channel gammatone filterbank with center frequencies ranging from 50 to 8,000 Hz. The output from each channel is then divided into 20-millisecond (ms) frames with 10-ms overlap, which forms a T-F representation (e.g., a cochleagram). It should be understood that the 64-channel gammatone filterbank and 20-ms frame rate is provided only as an example. This disclosure contemplates creating the T-F representation by other means including, but not limited to, using more or less frequency channels (e.g., 32-channel instead of 64-channel), using logarithmic instead of gammatone bandwidths/shapes, using longer or shorter frame sizes (e.g., 10 ms instead of 20 ms frames), and/or using more or less overlap (e.g., 0 ms instead of 10 ms overlap). It should be understood that the auditory processing method described herein is operable with other techniques for creating the T-F representation of the audio signal.

At step 806, each of the T-F units is classified into one of N discrete categories, where N is an integer greater than 2. This classification scheme is different than the ideal binary masking (IBM) technique described above, where T-F units are classified into only one of two categories (i.e., target-speech-dominant T-F units and noise-dominant T-F units) for attenuation. This classification scheme is also different than the ideal ratio masking (IRM) technique described above, where T-F units are attenuated on a continuum (i.e., no discrete categories). As described herein, there are advantages (e.g., algorithmic) when T-F units are categorized into more than two (2) discrete categories but less than an infinite number of categories. In some implementations, N is greater than or equal to 4. For example, an IQM technique with four attenuation steps (i.e., $IQM_4$) is described in the examples below. Alternatively or additionally, in some implementations, N is less than or equal to 8. For example, an IQM technique with eight attenuation steps (i.e., $IQM_8$) is described in the examples below. It should be understood that different numbers of attenuation steps (value of N) as compared to those in the examples (e.g., N=4 or N=8) can be used such as N=16. It should be understood that N can have a value other than 4, 8, and 16, which are provided only as examples. At step 808, the T-F representation of the audio signal is attenuated, where a respective level of attenuation for each of the T-F units is determined by its respective classification. In some implementations, each of the N discrete categories can be associated with a different level of attenuation, and all units in each category receive the same attenuation.

When the separate/unmixed target signal and noise are known (e.g., "oracle" masking), each of the T-F units can be classified into one of N discrete categories based on its respective signal strength and/or signal quality. Optionally, each of the T-F units can be classified based on its signal-to-noise ratio (SNR). For example, in an $IQM_4$ implementation, there are four different levels of attenuation, which are applied to T-F units based on the SNR of the T-F units. As described above, the target speech-plus-noise mixture (i.e., the audio signal) is divided in both time and frequency into T-F units at step 804, the T-F units are classified into one of N discrete categories according to the relationship between the speech and the noise within the T-F unit at step 806, and then each T-F unit is scaled in level according to which category it falls into. T-F units with less favorable SNRs are attenuated more than T-F units with more favorable SNRs, resulting in a signal containing T-F units largely dominated by the target speech signal.

When the separate/unmixed target signal and noise are unknown, the mask is "estimated" from the target-plus-noise mixture. This can be accomplished using machine learning. For example, each of the T-F units can be classified into one of N discrete categories using a machine-learning algorithm. The machine learning algorithm is trained to analyze and classify T-F units into categories. This can optionally be accomplished using, for example, the techniques described in: Healy, E. W., et al., "An algorithm to improve speech recognition in noise for hearing-impaired listeners," J. Acoust. Soc. Am. 134, 3029-3038, 2013; Healy, E. W., et al., "An algorithm to increase speech intelligibility for hearing-impaired listeners in novel segments of the same noise type," J. Acoust. Soc. Am. 138, 1660-1669, 2015; Healy, E. W., et al., "An algorithm to increase intelligibility for hearing-impaired listeners in the presence of a competing talker," J. Acoust. Soc. Am. 141, 4230-4239, 2017; or Chen J., et al., "Large-scale training to increase speech intelligibility for hearing-impaired listeners in novel noises," J. Acoust. Soc. Am. 139, 2604-2612, 2016. Optionally, the machine-learning algorithm can be a neural network including, but not limited to, a deep neural network (DNN), a recurrent neural network (RNN), a convolutional neural network (CNN), a perceptron, a long-short term memory (LSTM), a gated recurrent unit (GRU), a Hopfield network (HN), a Boltzmann machine, a deep belief network, an autoencoder, a generative adversarial network (GAN), a bitwise neural network, or a binarized neural network. It should be understood that a neural network is only one example algorithm. This disclosure contemplates using algorithms other than neural networks to classify T-F units. These may involve techniques other than machine learning. In an $IQM_4$ implementation, there are four different levels of attenuation, which are applied to T-F units based on the categories to which the T-F units are classified. T-F units dominated by noise are attenuated more than T-F units dominated by target speech, resulting in a signal containing T-F units largely dominated by the target speech signal.

At step 810, a synthesized signal is then created from the attenuated T-F representation of the audio signal. The signal-to-noise ratio (SNR) of the synthesized signal can be greater than a SNR of the audio signal (i.e., the audio signal collected by the microphone). In other words, the auditory processing method described herein can be used to improve the signal strength and/or signal quality. As described above, the synthesized signal can be converted into acoustic energy using a receiver (e.g., receiver 805 in FIG. 11B) such as a speaker.

EXAMPLES

Example 1. Intelligibility for Normal-Hearing Subjects Resulting from Various Time-Frequency Masks In Example 1 (Ex. 1), intelligibility was assessed in each of the five conditions of T-F masking. The speech materials selected were standard word lists, because sentences tend to produce ceiling intelligibility values at or near 100% when subjected to both IBM and IRM processing. Ex. 1a involved broadband word stimuli, and Ex. 1b involved the same stimuli subjected to band-pass filtering, in order to further avoid ceiling effects and better reveal differences across conditions. The background noise employed involved recordings from a busy cafeteria. It was selected for ecological validity and to possess variety of sound sources and types, including the babble of multiple talkers, the transient impact sound of dishes, and other environmental sounds.

Method

Subjects

A total of 20 subjects participated, 10 in Ex. 1a and 10 in Ex. 1b. All were native speakers of American English and had NH as defined by audiometric thresholds of 20 dB HL or better at octave frequencies from 250 to 8000 Hz on day of test (ANSI, 2004, 2010). The exception was one subject with a threshold of 25 dB HL at 8000 Hz in one ear. Ages ranged from 19 to 29 years (mean=20.9 years) and all were female. Care was taken to ensure that no subject had prior exposure to the speech materials employed.

Stimuli

The speech materials for both Exs. 1a and 1b were from the Central Institute for the Deaf (CID) W-22 test (Hirsh et al., 1952), drawn from a compact disk (CD) from AUDITEC, INC. of St. Louis, Mo. The test includes 200 phonetically balanced words in the carrier phrase, "Say the word _____". Five words were excluded (mew, two, dull, book, there), based on low frequency of occurrence or poor articulation/recording quality, to yield 195 words. The background cafeteria noise was also from an Auditec CD. It was approximately 10 minutes in duration and consisted of three overdubbed recordings made in a busy hospital-employee cafeteria. Noise segments having random start points and durations equal to each word in its carrier phrase were mixed with each speech utterance at an overall SNR of −10 dB.

The files were down-sampled to 16 kHz for processing in MATLAB of MATHWORKS, INC. of Natick, Mass. Preparation of the T-F masks began by dividing each speech+noise mixture into a T-F representation. The cochleagram representation (Wang and Brown, 2006) was employed. This involved first filtering into 64 gammatone bands having center frequencies ranging from 50 to 8000 Hz evenly spaced on the equivalent rectangular bandwidth scale (Glasberg and Moore, 1990). Each band was then divided into 20-ms time segments having 10 ms overlap using Hanning windowing. This same T-F representation was used for the creation of all the T-F masks.

Preparation of the IBM. The IBM consists of a two-dimensional array of 1's and 0's, one value for each T-F unit. Its processing followed that employed by us previously (Healy et al., 2013; 2014). The SNR within each T-F unit was calculated based on the pre-mixed signals. If the SNR was greater than a fixed local criterion (LC) value, the unit was concluded to be target-speech dominated and it was assigned a value of 1. Inversely, if that SNR was lesser or equal to LC, the unit was concluded to be noise dominated and it was assigned a value of 0. That is, $$IBM(t, f) = \begin{cases} 1, \text{ if } SNR(t, f) > LC \\ 0, \text{ otherwise} \end{cases}, \quad (1)$$

where SNR(t, f) denotes the SNR within the T-F unit centered at time t and frequency f. LC was set to −15 dB, in order to be 5 dB below the overall SNR. To create the IBM-processed signals, the mask was applied to the speech-plus-noise mixture by gating (multiplying) the mixture using the mask.

Preparation of the IRM. The IRM also consists of a two-dimensional array of values, one for each T-F unit, but these values are continuous. IRM processing also followed that employed by us previously (Healy et al., 2015; 2017; Chen et al., 2016). It was also based on the relative energies of speech versus noise within each T-F unit, as defined by $$IRM(t, f) = \sqrt{\frac{S(t, f)}{S(t, f) + N(t, f)}} = \sqrt{\frac{SNR(t, f)}{SNR(t, f) + 1}}, \quad (2)$$

where S(t, f) is the speech energy contained within the T-F unit centered at time t and frequency f and N(t, f) is the noise energy contained within the same unit. The mask was applied to the speech-plus-noise mixture, again by weighting each mixture T-F unit by the value of the IRM for that unit.

c. Preparation of the IQM. Ideal quantized masks were created having three, four, and eight attenuation steps ($IQM_3$, $IQM_4$, $IQM_8$). The SNR boundaries corresponding to each step of the IQM and the attenuation corresponding to each step of the IQM were based on the IRM function. The SNR boundaries were centered such that the $IQM_2$ would equal the IBM (having an LC value 5 dB below the overall mixture SNR) once scaled for overall level. The center SNR boundaries of the $IQM_4$ and $IQM_8$ (between steps 2 and 3 in the $IQM_4$ and between steps 4 and 5 in the $IQM_8$) also equaled the single IBM division. The attenuation assigned to each step (the IQM value) was equal to the attenuation assigned by the IRM (the IRM value) at the lower SNR boundary for the step. The exception was that the lowest step was always assigned a value of 0, like the IBM.

The process began with the selection of a series of points on the IRM function, according to equations 3 and 4, $$p = -\log_2\sqrt{\frac{10^{(LC/10)}}{10^{(LC/10)} + 1}} \quad (3)$$

$$x_n(t, f) = \left(\frac{n-1}{N}\right)^p \quad (4)$$

where the exponent p was selected based on the LC for the IBM (−15 dB), such that the $IQM_2$ discarded the same units as the IBM. N represents the total number of steps in the IQM, and n=1, . . . , N and represents the ordinal position of each step.

These points became the SNR boundaries and attenuation values for the IQM, as in equation 5.

$$IQM_N(t, f) = \begin{cases} x_1(t, f) & \text{if } 0 \le IRM(t, f) \le x_2(t, f) \\ x_2(t, f) & \text{if } x_2(t, f) < IRM(t, f) \le x_3(t, f) \\ & \vdots \\ x_N(t, f) & \text{if } x_N(t, f) < IRM(t, f) \le 1 \end{cases} \quad (5)$$

As with the other two masks, the IQM was applied by multiplying the stepped mask with the speech-plus-noise mixture. FIG. 1A displays the SNR boundaries for each step of each IQM employed (top panel), and FIG. 1B displays the attenuations produced by each step of each IQM employed (bottom panel). Every stimulus was scaled after processing to the same overall root-mean-square level, making all of the attenuations relative and eliminating differences in overall level.

Whereas the IBM takes values of either 0 or 1, the IRM takes on values bounded by 0 and 1. Although the IRM is capable in theory of zeroing T-F units, it is potentially notable that this will generally not occur because the likelihood of zero signal energy within a T-F unit is nil. But like the IBM, the current IQM was designed to zero all T-F units at the lowest step. This decision was made to reduce the perception of low-level noise arising from the T-F units having the least-favorable SNRs. The implementation of the IQM based on existing T-F masks described herein was done to facilitate direct comparison to these existing masks.

Table I lists the SNR boundaries for each step in each IQM employed, and Table II lists the attenuations produced by each IQM employed. Every stimulus was scaled after processing to the same total RMS sound-pressure level, making all of the attenuations relative and eliminating differences in overall level.

TABLE I

SNR boundary values (dB) for the binary mask and for the example quantized masks employed.

| | Step 1 | 2 | 3 | 4 | 5 | 6 | 7 | 8 |
|---|---|---|---|---|---|---|---|---|
| IBM | ≤−15.00 | >−15.00 | — | — | — | — | — | — |
| $IQM_3$ | ≤−23.97 | (−23.97, −8.25] | >−8.25 | — | — | — | — | — |
| $IQM_4$ | ≤−30.27 | (−30.27, −15.00] | (−15.00, −5.12] | >−5.12 | — | — | — | — |
| $IQM_8$ | ≤−45.41 | (−45.41, −30.27] | (−30.27, −21.39] | (−21.39, −15.00] | (−15.00, −9.83] | (−9.83, −5.12] | (−5.12, 0.19] | >0.19 |

TABLE II

| | Attenuation values (dB) for the example quantized masks employed | | | | | | | |
|---|---|---|---|---|---|---|---|---|
| | Step 1 | 2 | 3 | 4 | 5 | 6 | 7 | 8 |
| $IQM_3$ | −∞ | −11.99 | −4.43 | — | — | — | — | — |
| $IQM_4$ | −∞ | −15.14 | −7.57 | −3.14 | — | — | — | — |
| $IQM_8$ | −∞ | −22.70 | −15.14 | −10.71 | −7.57 | −5.13 | −3.14 | −1.46 |

Following processing, each utterance in each condition was normalized to the same overall root-mean-square level, in order to remove differences in overall intensity. The broadband stimuli processed as just described were used for Ex. 1a. For Ex. 1b, the same stimuli were subjected to band-pass filtering from 750 to 3000 Hz. A single pass through a 2000-order finite-duration impulse response filter was employed, resulting in steep filter slopes that exceeded 1,000 dB/octave.

Procedure

The procedures for Exs. 1a and 1b were identical. The experiment was divided into three blocks, each involving 13 words in each mask condition (IBM, $IQM_3$, $IQM_4$, $IQM_8$, IRM), for a total of 39 words/condition. The order of mask conditions was random for each block and subject, as was the word list-to-condition correspondence. The stimuli were converted to analog form using GINA 3G digital-to-analog converters from ECHO DIGITAL AUDIO CORPORATION of Santa Barbara, Calif. and presented diotically over HD 280 headphones from SENNEISER ELECTRONIC GmbH & Co. of Wedemark, Germany. The presentation level was set to 65 dBA at each earphone at the start of each session using a flat-plate coupler and sound level meter (Larson Davis AEC 101 and 824, Depew, N.Y.). Subjects were tested individually in a double-walled audiometric booth seated with the experimenter. The subjects were instructed to repeat each word back as best they could after hearing each and were encouraged to guess if unsure. No word was repeated for any listener. The experimenter controlled the presentation of words and recorded responses. Testing began with a brief practice in which subjects heard words from the Consonant-Nucleus-Consonant (CNC) corpus (Lehiste and Peterson, 1959). These were also standard recordings produced by a male talker and in a carrier phrase ("Ready, _____."). Subjects heard five CNC words in each mask condition in order of decreasing number of attenuation steps (IRM, $IQM_8$, $IQM_4$, $IQM_3$, IBM). Feedback was provided during practice but not during formal testing.

Results and Discussion

Human Subjects Results

Figures 1C, 1D:
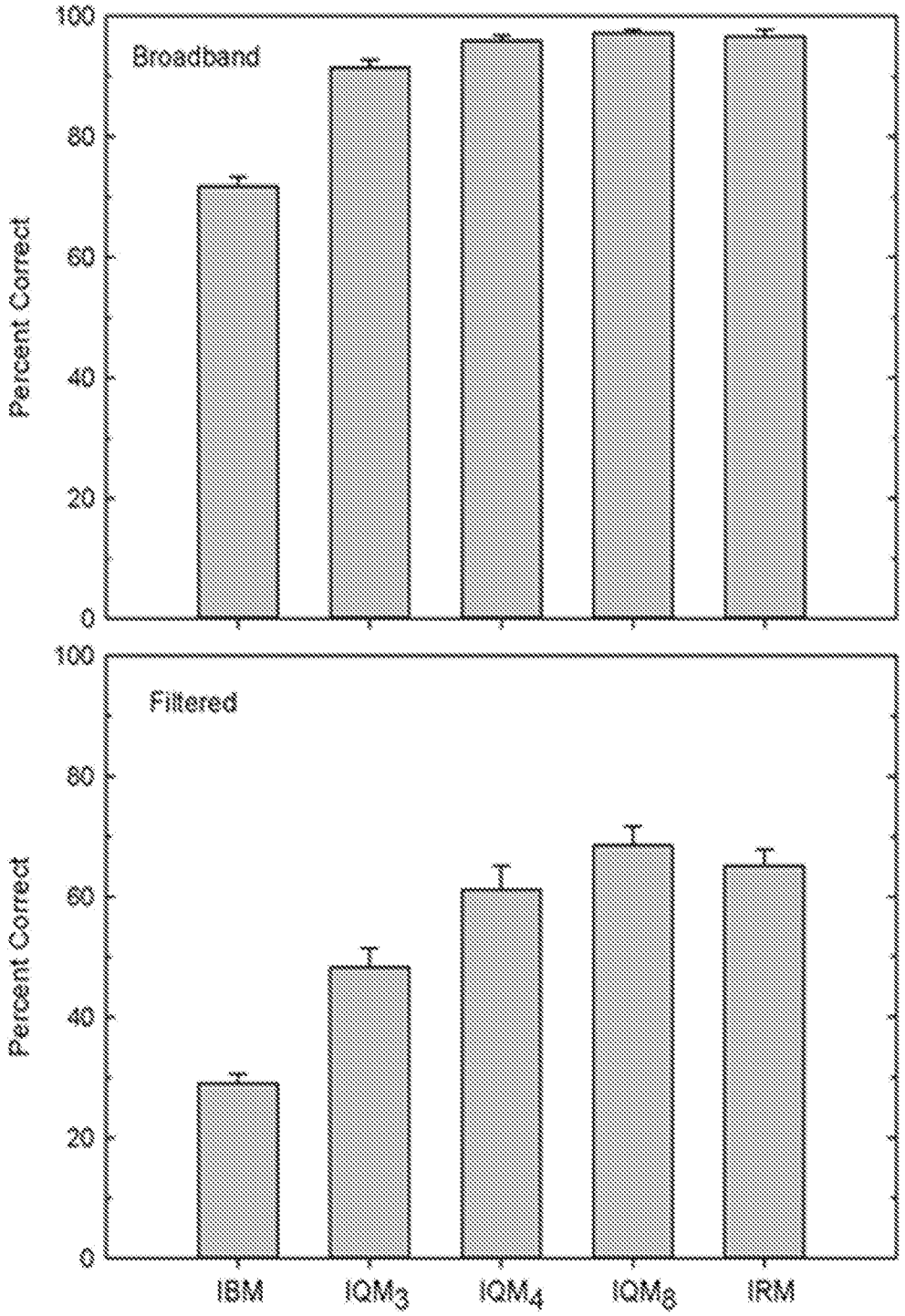
FIGS. 1C and 1D illustrate group mean W-22 word recognition (and standard errors) for normal-hearing listeners hearing speech in cafeteria noise, processed by five different time-frequency masks. The top panel (FIG. 1C)

The FIG. 1C displays group mean word-recognition scores for each broadband T-F mask. Apparent in this panel is that all masks produced high recognition scores (above 70% correct), but that scores for the IBM were lower than those for the IQMs and the IRM, where all values are above 90% correct. The FIG. 1D displays scores for the group hearing the band-pass stimuli. Apparent is that scores were reduced below the ceiling, as desired, and that differences between speech-recognition scores emerged across the different masks. A first notable finding is that speech recognition produced by the IBM is not equal to that produced by the IRM, despite that both produce similar ceiling scores for sentence intelligibility. Instead, recognition scores were better for the IRM by 36 percentage points. A second primary finding is that scores were highest in the $IQM_8$ condition, and scores for the $IQM_4$ approximated that for the IRM. Thus, it appears that the intelligibility benefit of the IRM can be captured with as few as four attenuation steps. Finally, it is noted that the addition of any number of attenuation steps above two produced increased speech recognition.

The scores were transformed into rationalized-arcsine units (RAUs; Studebaker, 1985) and subjected to a two-way mixed analysis of variance (ANOVA) (2 filtering groups×5 mask conditions). The interaction between filtering and mask conditions was not significant [$F(4, 72)=0.9$, $p=0.45$], suggesting that the pattern of performance across different mask conditions was consistent across the filtering conditions. As anticipated, the main effect of filtering was significant [$F(1, 18)=359.6$, $p<0.001$], simply reflecting the desired reduction in scores associated with filtering. Most critically, the main effect of mask condition was significant [$F(4, 72)=86.3$, $p<0.001$]. Performance across the five pooled mask conditions were examined using Holm-Sidak pairwise post hoc comparisons. Performance did not differ significantly (corrected $p>0.05$) among the $IQM_4$, $IQM_8$, and IRM, where scores were within 4 percentage points ($p\geq0.15$). All other comparisons were significant, suggesting that the IBM and the $IQM_3$ produced lower recognition scores ($p<0.001$). The pattern of significant main effects and pairwise comparisons was identical when only the broadband RAU data and the filtered RAU data were subjected to separate 1-way repeated-measures ANOVAs, despite that the latter set of scores were all free of ceiling effects and therefore differed more widely across mask conditions.

Acoustic Intelligibility Estimates

Predicted intelligibility based on the acoustic stimuli was assessed using the short-time objective intelligibility measure (STOI; Taal et al., 2011). This measure reflects the correlation averaged across brief time windows between the temporal amplitude envelope of clean unprocessed speech versus that of speech-plus-noise following processing. The index therefore reflects the extent to which the envelope of the processed speech reflects that of the original clean speech, and it has been shown to be highly correlated with human speech intelligibility. For each mask condition, the STOI value was calculated for each of the 195 W-22 words plus carrier separately, then averaged to obtain means and variability estimates. Accordingly, standard deviations were calculated rather than standard errors, because each entry in the population estimate represents a single utterance, rather than a single human subject.

FIGS. 2A and 2B display these STOI values for the broadband stimuli employed in Ex. 1a (top panel, FIG. 2A) and the filtered stimuli employed in Ex. 1b (bottom panel, FIG. 2B). Apparent is that the STOI values are somewhat similar across conditions, which suggests that they underpredict the human speech-recognition differences observed across the five mask conditions (see Taal et al., 2011 for mapping functions between STOI and intelligibility). Most notable is the similarity across predicted scores observed for the Ex. 1b stimuli, where ceiling effects are absent.

Example 2A. Sound-Quality Ratings by Normal-Hearing Subjects for Various Time-Frequency Masks In this example, the focus was on subjective sound quality. Subjects compared utterances processed by two different T-F masks and rated which sound quality was preferred and by how much. Everyday sentences were employed, in order to provide a longer duration sample to judge and a more common communication unit. Further, sentences are highly intelligible when processed by both the IBM and the IRM (and so presumably by the IQM as well), removing the influence of differential intelligibility and allowing subjects to focus on sound quality. Finally, the sentence was the same across the two masks compared in each trial, in order to further focus the judgement on sound quality.

Method

Subjects

Ten subjects who had not participated in Ex. 1 were recruited. All had normal hearing on day of test as defined in Ex. 1, ages ranged from 19 to 21 years (average=19.9 years), and all were female. Care was taken to ensure that none had been exposed to the sentence materials employed in this experiment.

Stimuli

The speech stimuli employed were Central Institute of the Deaf (CID) everyday American speech sentences (Silverman and Hirsch, 1955; Davis and Silverman, 1978). These 100 sentences are contextually and grammatically plausible and range in length. They were produced by a professional male talker having a standard American English dialect and digitized at 22 kHz with 16-bit resolution. For the current experiment, sentence-length variability was reduced by selecting the 81 sentences containing three to eight words. These were intended to provide a sound sample that was long enough to generate a sound-quality judgement but short enough to facilitate repetitive back-and-forth comparison. The remaining 19 sentences that were as long as ten words or as short as two words were saved for practice.

The speech was mixed with the same cafeteria noise employed in Ex. 1, at the same SNR of −10 dB. Each sentence was mixed with a noise segment having a different random start point in the 10-minute file, two separate times, to create 162 unique mixtures. The processing of the noisy speech by the five T-F masks was identical to that employed in Ex. 1a (broadband speech), including the initial down sampling to 16 kHz.

Procedure

The sound-quality comparison procedure was modeled after that of Madhu et al. (2013), Koning et al. (2015), and Williamson et al. (2015). Subjects listened to pairs of stimuli, labeled A and B, and rated their preference for one over the other based on sound quality. Each of the five T-F masks was compared with each of the other masks and with itself, resulting in 15 comparisons. Each comparison was made 6 times, resulting in 90 trials/subject. For each subject, sentences-plus-noise were selected randomly without replacement for each trail, and the same sentences-plus-noise was used for both masks compared within each trial. The presentation order of mask comparisons was randomized, and the assignment to position A or B was counterbalanced so that each pair appeared three times in one orientation and three times in the other.

The subjects used custom presentation software that displayed two buttons labeled A and B, and a seven-point Likert-type scale (Likert, 1932) labeled "Strongly Prefer A; Moderately Prefer A; Slightly Prefer A; No Preference; Slightly Prefer B; Moderately Prefer B; Strongly Prefer B." The instructions were, "Select how much you prefer one sentence over the other in terms of sound quality. You may play each sentence as many times as you wish." It was also suggested to play each stimulus at least two or three times before rating. The stimuli were presented by pressing buttons A and B, and ratings were made by selecting one of the seven preferences on the scale, both using the computer mouse.

Prior to the task, each subject completed practice in which each of the 15 comparisons was presented twice and the assignment to A and B was random. The practice CID sentences not used for formal testing were used for this stage. Subjects were tested while seated alone in a double-walled sound booth. As in Ex. 1, stimuli were heard diotically at 65 dBA over Sennheiser HD 280 Pro headphones, and calibration was performed at the start of each session.

Results

Human Subjects Results

To quantify the sound-quality ratings, points were assigned as follows: No Preference=0; Slightly Prefer=1; Moderately Prefer=2; and Strongly Prefer=3. FIG. 3 displays the points corresponding to each comparison, averaged across subjects. Each panel corresponds to a single mask (the reference), and the columns within that panel represent the ratings for the various masks against the reference. Positive values indicate that the extent to which the comparison mask was preferred over the reference, and negative values indicate the extent to which the comparison mask was not preferred over the reference (i.e., the extent to which the reference was preferred). A value of 3.0 would indicate that the comparison was preferred over the reference in every trial by every subject, a value of 0.0 would indicate that no preference existed on average, and a value of −3.0 would indicate that the reference was preferred over the comparison in every trial by every subject.

It is first notable that the comparison of each mask against itself yielded a group mean rating of essentially 0.0, corresponding to no preference and suggesting that the subjects were rating the masks accurately. Second, the previously established sound-quality advantage of the IRM over the IBM is also observed in these data, as the right-most column in the top panel and the left-most column in the bottom panel. The magnitude of this preference corresponded to Strongly Prefer.

With regard to the IQM, FIG. 3 indicates that subjects preferred its sound quality over that of the IBM. This is apparent in the top panel, where IQM preference values are all positive (and in each of the IQM reference panels, where the value for the IBM is negative). The magnitude of the preference was between Moderately and Strongly Prefer for the $IQM_4$ and $IQM_8$. FIG. 3 also indicates that the sound quality of $IQM_4$ and $IQM_8$ matched or was slightly preferred over that of the IRM. This is apparent in the bottom panel, where the $IQM_4$ and $IQM_8$ ratings are slightly positive relative to the IRM (It can also be seen in the $IQM_4$ and $IQM_8$ reference panels, where the IRM ratings are slightly negative).

Paired replicates Wilcoxon signed rank tests were conducted to compare the sound-quality ratings for the 10 unique comparisons among T-F masks. The difference in ratings was found to be statistically significant for eight of the ten comparisons [$|W| \geq 30.00$, $p \leq 0.04$]. For each significant difference, the mask with a greater number of attenuation steps was rated as preferable over the mask having fewer steps. The sound-quality ratings did not differ significantly for the $IQM_4$ versus IRM [$W=9.00$, $p=0.55$], and for the $IQM_8$ versus IRM [$W=26.00$, $p=0.08$].

FIG. 4 displays the percentage of trials that were preferred when masks were compared that were adjacent along the number of attenuation steps continuum. For this analysis, 50% indicates a rating of No Preference. The figure shows that an increase in attenuation steps from two (IBM) to three ($IQM_3$) caused the sound quality of the latter to be preferred in over 95% of the comparisons. The preference proportion is reduced as comparisons involve larger numbers of attenuation steps, with $IQM_4$ preferred more often than $IQM_3$, and $IQM_8$ preferred slightly more often than $IQM_4$. But that trend reverses once eight attenuation steps are reached, as the sound quality of the $IQM_8$ was preferred slightly more often than that of the IRM.

Acoustic Sound-Quality Estimates

Sound-quality estimates corresponding to the five masks were also assessed using the Perceptual Evaluation of Speech Quality (PESQ; Rix et al., 2001). PESQ is a standard measure of speech-sound quality based on acoustic measurement and has a scale ranging from −0.5 to 4.5. Like STOI, it reflects a comparison between clean unprocessed speech and speech-plus-noise following processing. Values were calculated for each of the CID sentence sound mixtures employed in Ex. 2a (2 noises/sentence), in each of the mask conditions. Mean (and standard deviation) PESQ values are displayed in FIG. 5. Apparent is that the PESQ value increases as the number of attenuation steps exceeds two (IBM versus $IQM_3$), and that values are similar for the $IQM_3$, $IQM_4$, and IRM. Comparisons across the scales corresponding to STOI and PESQ are difficult to make, but unlike the STOI values in FIGS. 2A and 2B, the PESQ values appear to display a pattern across the five mask conditions that reflects the pattern of human-subject ratings (also see FIG. 6).

Example 2b. Confirming Similar Sentence Intelligibility Across Mask Conditions

Several steps were taken in Ex. 2a to isolate the subject's judgement on subjective sound quality and control the potentially interfering influence of differential intelligibility. Those subjects participated in no intelligibility experiments, the experimenter remained outside of the sound booth to avoid exposure to another voice that could potentially influence sound quality judgements, and the stimuli employed were simple sentences, which were assumed to have similar (ceiling) intelligibility across T-F mask conditions. Ex. 2b was undertaken to confirm the intelligibility of the sentence stimuli employed in Ex. 2a.

Method

Ten subjects were recruited from the same population as in Exs. 1 and 2a. Nine completed the current experiment after completing Ex. 4 involving different speech materials. All had NH as defined in Ex. 1, ages ranged from 19 to 24 years (average=22.0 years), and five were female. Again, care was taken to ensure that none had been exposed to the sentence materials employed in this experiment. The stimuli were the same CID sentence recordings, each mixed with two cafeteria-noise segments at −10 dB SNR, then subjected to the five T-F mask conditions, all as employed in Ex. 2a. No sentences were excluded for length in this experiment, as the inclusion of very long and very short sentences would likely only serve to reduce intelligibility. Subjects 1-5 heard one set of mixtures and subjects 6-10 heard the other set. Each subject heard 20 sentences in each of the five T-F mask conditions. The order of conditions was balanced such that each appeared in each serial position an equal number of times across subjects. The presentation of stimuli and collection of responses involved the same apparatus and procedures as in Ex. 1. Subjects were instructed to report back each sentence after hearing it and to guess if unsure.

Results and Discussion

The CID sentences each contain a number of scoring keywords, which generally correspond to all the content words and exclude the articles. The percentage of keywords correctly reported for the 20 sentences in each condition was calculated. These group means were 99% for sentences processed by the IBM and 100% for the remaining T-F masks ($IQM_3$, $IQM_4$, $IQM_8$, and IRM) thus confirming the high and uniform intelligibility of the stimuli employed for sound-quality judgements in Ex. 2a.

Example 3. Sound-Quality Rankings by Normal-Hearing Subjects for Various Time-Frequency Masks In this example, subjects ranked the five T-F mask conditions in order of subjective sound quality. The same highly intelligible everyday sentence was used for each mask. The use of number or letter labels for the masks was avoided because they carry inherent order characteristics. Instead, each mask was assigned an arbitrary shape. Further, these shapes were arranged in a circle on the subject interface to further diminish any implication of linear ordering.

Method

Subjects

The subjects were those employed for Exs. 1a, 1b, and 2a, with the exception of one subject from Ex. 1a and one subject from Ex. 1b. There were then 28 subjects, all female, aged 19 to 29 years (average=20.6 years).

Stimuli and Procedure

This experiment was completed immediately following the other experiment that each subject participated in, at the of the same session. The stimuli were drawn from Ex. 2a and so involved the CID everyday speech sentences in cafeteria noise. The first 28 sentences used for formal testing were used in order to have a different sentence for each subject. Subjects heard that one sentence, mixed with a single noise sample, processed by each of the five T-F masks. The labels assigned to the masks were circle, triangle, star, diamond, and square. The correspondence between shape and mask condition was randomized for each subject, but the shapes always appeared in the same position on the screen, allowing the mask-condition position on the screen to also be randomized for each subject. Subjects played the sentence processed by each mask by using the computer mouse to press each of five shape-labeled buttons arranged in a circle on a computer monitor. The presentation of stimuli involved the same apparatus, presentation levels, and calibration as in Exs. 1 and 2. Subjects ranked the shapes in order according to the preferred sound quality of the corresponding stimulus. They did so by placing in order paper cards displaying each shape on a table in front of the computer monitor labeled "Best" at one end and "Worst" at the other. The subjects were instructed to play each sentence as many times as desired and they were allowed to place and move the cards as they wished. The final ordering of the cards was documented by the experimenter.

Results and Discussion

FIGS. 6A-6D display the average rank assigned to each T-F mask by each subject subgroup, with 1 being the least preferred and 5 being the most preferred. Panels A through C (FIGS. 6A-6C) correspond to the three subject groups who performed the task at the end of Exs. 1a (FIG. 6A), 1b (FIG. 6B), and 2a (FIG. 6C), respectively. Panel D (FIG. 6D) displays the mean rankings across panels. Apparent is the difference in sound-quality preference ranking for the IBM versus the IRM. The IBM value equaling 1.0 in Panels B and C (FIGS. 6B and 6C) indicate that it was the least preferred of the five masks for every subject, and the value just exceeding 1.0 in Panel A (FIG. 6A) reflects that it was the least preferred by 8 of the 9 subjects. Also apparent is the increase in sound-quality ranking as more than two attenuation steps are introduced. On average across groups, the $IQM_4$ rating approximates that for the IRM. And for each subject group, the $IQM_8$ rating matches or exceeds that for the IRM.

It is not simple to predict the influence that a prior task can have on judgements of subjective sound quality. This is why the current experiment was repeated with each of the subjects in Exs. 1a, 1b, and 2a. In these prior experiments, subjects heard speech that was similarly (Ex. 1a) or equally intelligible (Ex. 2a) in each condition, and focused on intelligibility (Ex. 1a and 1b) or sound quality (2a). Perhaps as a result of these differing prior experimental experiences, the patterns across panels A-C (FIGS. 6A-6C) differ somewhat. Obviously, if one had to choose which pattern was most representative of the population based on statistical variability and sampling theory, the mean would be selected (panel D, FIG. 6D). But it is also likely that immediately prior conditions involving intelligibility (as is often involved in research of this type) can influence subsequent judgements of subjective sound quality. It is reasonable to assume that a more understandable stimulus will become "preferred" after many intelligibility trials, potentially making it difficult to assess sound quality free of this preference bias in subsequent trials. Accordingly, it is possible to speculate that the subjects whose immediately prior experience with the same processing involved only judgements of sound quality best represent "pure" or uninfluenced subjective sound-quality judgements. It is notable that this group of subjects (panel C, FIG. 6C) ranked both the $IQM_4$ and the $IQM_8$ substantially higher in sound quality than the IRM.

Example 4. Intelligibility for Normal-Hearing Subjects Produced by Various Time-Frequency Masks in a Highly Modulated Background In this example, the intelligibility resulting from each of the five T-F masks was assessed for speech in a different background noise—interference consisting of a single competing talker. The rationale for this background is twofold. First, it was of general interest to assess the ideal quantized masking of speech in a more heavily modulated background. But more specifically, the different background may influence the IRM−IBM difference that the IQM is attempting to bridge (see Madhu et al., 2013; Koning et al., 2015). The stimuli in this experiment were filtered as in Ex. 1b, in order to eliminate ceiling effects and maximize the ability to observe differences across T-F masks.

Method

Subjects

A total of ten NH subjects were recruited from the population employed for Exs. 1-3. Ages ranged from 19 to 24 years (mean=22.0 years), and six were female. Normal hearing was defined as in Ex. 1., and these subjects were all entirely naïve to the speech materials employed.

Stimuli and Procedure

The stimuli were highly similar to those employed in Ex. 1b, in order to facilitate direct comparison. The same 195 CID W-22 word recordings were employed as target stimuli. The background consisted of sentences from the AzBio test (Spahr et al., 2012). These were standard recordings involving a single male talker. The sentences were concatenated and a background was selected for each target utterance by selecting a segment having a random start point and the same duration as the target speech. Each of the target-speech utterances was mixed with background interference at both −10 and −20 dB SNR, to create two sets of stimuli. The motivation for the more highly negative SNR comes in part from Madhu et al. (2013) and Koning et al. (2015), who found that the IRM−IBM difference can be larger at more negative SNRs. The same target speech-interference pairs were employed for both SNRs, in order to isolate the effect of SNR. This speech-plus-noise was subjected to the five T-F masking conditions using the same processing employed in Ex. 1b, including the same 750-3000 Hz filtering. Also as in Ex. 1, the LC was 5 dB below the input SNR.

Procedure

The presentation of signals and testing of subjects was accomplished using the apparatus and procedures of Ex. 1. Subjects were randomly assigned to one of two groups, each hearing a different overall SNR. As in Ex. 1., subjects heard 13 words in each T-F mask condition in each of three blocks, and condition order and word list-to-condition correspondence was randomized for each subject. Also as in Ex. 1, practice using the same 25 CNC words preceded formal testing. In the current experiment, the first 5 practice words were heard unfiltered, one in each T-F mask condition, followed by 4 words in each mask condition in order of decreasing number of attenuation steps. The SNR employed for practice was the same as that employed for formal testing.

Results and Discussion

FIGS. 7A and 7B display group mean intelligibility in each T-F mask condition. Scores for the group hearing the SNR of −10 dB are displayed in the top panel (FIG. 7A) and scores for the group hearing −20 dB are in the bottom panel (FIG. 7B). The pattern of scores across T-F mask conditions is highly similar to that observed for the cafeteria-noise background in FIG. 1 (where the lower panel represents similarly filtered conditions). The IRM produced higher scores than the IBM at both SNRs, the $IQM_3$ showed improvements over the IBM, and scores for the $IQM_4$ and $IQM_8$ match or exceed those observed for the IRM. It is potentially interesting to note that scores for the $IQM_8$ are all highly similar (approximately 70% correct) for the different noise types and SNRs employed across experiments, whereas scores for the IBM and IRM appear to depend more on these factors.

Scores were subjected to RAU transform and a 2-way mixed ANOVA (2 SNR groups×5 mask conditions). Both main effects (SNR: [$F(1,8)=29.9$, $p<0.001$], mask: [$F(4, 32)=44.9$, $p<0.001$]) and the interaction [$F(4, 32)=3.8$, $p<0.05$] were significant. Post hoc Holm-Sidak pairwise comparisons among the five T-F mask conditions at −10 dB SNR indicated that scores improved over the IBM whenever three or more attenuation steps were employed ($p\leq 0.02$). But scores across conditions containing three or more steps did not differ ($p\geq 0.10$). Comparisons at −20 dB SNR revealed the same pattern of significance, with the addition that scores for the $IQM_8$ were significantly higher than those for both the $IQM_3$ (<0.001) and the IRM ($p=0.03$).

Example 5. Intelligibility for Hearing-Impaired Subjects Resulting from Various Time-Frequency Masks This example is essentially identical to Ex. 1, in which intelligibility was assessed in normal-hearing subjects, except that subjects with hearing loss were employed.

Method

Subjects

A group of 10 individuals with sensorineural hearing loss participated. All were bilateral hearing aid wearers chosen to represent typical patients of the Ohio State University Speech-Language-Hearing Clinic. Ages ranged from 61 to 73 years and averaged 67 years. Six were female. FIG. 8 illustrates the average audiograms for these subjects. Apparent is their typically sloping hearing loss configuration, which ranges in severity from mild to moderately severe across frequencies. These subjects were paid for their participation.

Stimuli and Procedures

The experimental stimuli, apparatus, and procedures were all identical to those employed for normal-hearing subjects in Ex. 1, with the following exceptions. The same group of subjects heard both broadband and filtered signals, and so the number of words in each condition was halved. Also, the signals were amplified to account for the hearing loss of each individual subject according to the NAL-RP hearing-aid fitting formula. This was accomplished using a RANE DEQ60L digital equalizer.

Results

FIG. 9 displays group mean word recognition (and standard errors) for each time frequency mask. The figure is analogous to FIGS. 1C and 1D. The broadband signals are represented by black bars and the filtered signals are represented by grey bars. Apparent is the increase in word recognition from the IBM to the IRM, in both broadband and filtered conditions. Also apparent is that the $IQM_3$ appears to capture this intelligibility gain and essentially match the intelligibility produced by the IRM. A two-way ANOVA and posthoc analyses (Holm Sidak) on rationalized arcsine values indicated that scores were lower in the IBM conditions, but did not differ significantly across any other conditions. Hence, scores in all IQM conditions were equivalent to those in IRM.

Example 6. Sound Quality Rankings of Various Time-Frequency Masks by Hearing-Impaired Subjects This example was essentially identical to Ex. 3, in which sound quality was assessed in normal-hearing subjects, except that subjects with hearing loss were employed.

Method

The hearing-impaired subjects were the same as in Ex. 5. The experimental stimuli, apparatus, and procedures were all identical to those employed for normal-hearing subjects in Ex. 3, except that the hearing-impaired subjects completed three rounds of the task, each with a new randomly selected sentence, rather than just one round. NAL-RP hearing-aid gains were implemented as in Ex. 5.

Results

FIG. 10 displays the average rank assigned to each T-F mask by the hearing-impaired subjects, with 1 being the least preferred and 5 being the most preferred. Apparent is the difference in sound-quality preference ranking for the IBM versus the IRM. Also apparent is the increase in sound-quality ranking as more than two attenuation steps are introduced. The $IQM_4$ rating approximates that for the IRM, and the $IQM_8$ rating exceeds that for the IRM.

Conclusions

Intelligibility

1. When ceiling effects are removed, the IBM and IRM produce different intelligibilities of speech in noise, with the IRM being superior.

2. Intelligibility benefit is observed when more than two attenuation steps are introduced to the T-F mask. Accordingly, all of the IQMs displayed higher intelligibility than the IBM.

3. The intelligibility benefit of the IRM can be entirely captured with a few as 4 to 8 IQM steps ($IQM_4$, $IQM_8$). The IQMs numerically or significantly exceeded the intelligibility of the IRM in every condition.

4. In normal-hearing subjects, conclusions 1-3 hold for both ecologically valid cafeteria noise (Exs. 1a, 1b) and more highly modulated single-talker interference (Ex. 4).

5. Conclusions 1-3 also hold (in cafeteria noise) for hearing impaired subjects who represent typical hearing aid wearers (Ex. 5).

6. The acoustic analysis STOI did not predict the intelligibility differences observed currently across the T-F masks tested.

Sound Quality

1. Sound-quality ratings improve when more than two attenuation steps are added to the time-frequency mask. Accordingly, all of the IQMs were rated more favorably than the IBM. The $IQM_3$ was preferred in over 95% of the comparisons to the IBM, and the magnitude of the preference over the IBM was Moderately to Strongly Prefer for $IQM_4$ and $IQM_8$.

2. The sound-quality advantage of the IRM over the IBM can be entirely captured by an IQM having as few as 4 to 8 attenuation steps ($IQM_4$, $IQM_8$). The sound-quality ratings for the $IQM_4$ and $IQM_8$ were slightly above that for the IRM.

3. The ranking of T-F masks from least to most preferred based on subjective sound quality also revealed that the sound-quality advantage of the IRM over the IBM can be entirely captured with as few as 4 to 8 attenuation steps. On average, the sound-quality rankings for the $IQM_4$ and $IQM_8$ approximated or exceeded that for the IRM.

4. These sound-quality ranking conclusions for normal-hearing subjects also hold for hearing impaired subjects (Ex. 6).

5. The acoustic analysis PESQ predicted the pattern of sound-quality ratings and rankings across T-F masks observed currently.

6. It is suggested that prior exposure to conditions involving an intelligibility task can influence subsequent judgements of subjective sound quality for stimuli processed in similar fashion. But one can speculate that this influence is diminished if the prior task involves (i) the intelligibility of stimuli all having similar or the same intelligibilities, or (ii) only sound-quality judgements of speech stimuli having similar or the same intelligibilities.

Computational Aspects

1. Estimation of the IQM by machine-learning or other means involves classification, like the IBM but unlike the regression-based IRM. This characteristic can possess computational advantages. The IQM can also possess advantages over the IRM in terms of the perceptual ramifications of estimation error.

Example Computing Device

It should be appreciated that the logical operations described herein with respect to the various figures may be implemented (1) as a sequence of computer implemented acts or program modules (i.e., software) running on a computing device (e.g., the computing device described in FIG. 12), (2) as interconnected machine logic circuits or circuit modules (i.e., hardware) within the computing device and/or (3) a combination of software and hardware of the computing device. Thus, the logical operations discussed herein are not limited to any specific combination of hardware and software. The implementation is a matter of choice dependent on the performance and other requirements of the computing device. Accordingly, the logical operations described herein are referred to variously as operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

Referring to FIG. 12, an example computing device 900 upon which embodiments of the invention may be implemented is illustrated. It should be understood that the example computing device 900 is only one example of a suitable computing environment upon which embodiments of the invention may be implemented. Optionally, the computing device 900 can be a well-known computing system including, but not limited to, personal computers, servers, handheld or laptop devices, multiprocessor systems, microprocessor-based systems, network personal computers (PCs), minicomputers, mainframe computers, embedded systems, and/or distributed computing environments including a plurality of any of the above systems or devices. Optionally, the computing device 900 can be included in a hearing aid, cochlear implant, telephone, public address system, headset communication device, vehicle communication device, military communication device, aviation communication device, two-way radio, or walkie-talkie. Distributed computing environments enable remote computing devices, which are connected to a communication network or other data transmission medium, to perform various tasks. In the distributed computing environment, the program modules, applications, and other data may be stored on local and/or remote computer storage media.

In its most basic configuration, computing device 900 typically includes at least one processing unit 906 and system memory 904. Depending on the exact configuration and type of computing device, system memory 904 may be volatile (such as random access memory (RAM)), non-volatile (such as read-only memory (ROM), flash memory, etc.), or some combination of the two. This most basic configuration is illustrated in FIG. 12 by dashed line 902. The processing unit 906 may be a standard programmable processor that performs arithmetic and logic operations necessary for operation of the computing device 900. The computing device 900 may also include a bus or other communication mechanism for communicating information among various components of the computing device 900.

Computing device 900 may have additional features/functionality. For example, computing device 900 may include additional storage such as removable storage 908 and non-removable storage 910 including, but not limited to, flash memory or magnetic or optical disks or tapes. Computing device 900 may also contain network connection(s) 916 that allow the device to communicate with other devices. Computing device 900 may also have input device (s) 914 such as a keyboard, mouse, touch screen, etc. Output device(s) 912 such as a display, speakers, printer, etc. may also be included. The additional devices may be connected to the bus in order to facilitate communication of data among the components of the computing device 900. All these devices are well known in the art and need not be discussed at length here.

The processing unit 906 may be configured to execute program code encoded in tangible, computer-readable media. Tangible, computer-readable media refers to any media that is capable of providing data that causes the computing device 900 (i.e., a machine) to operate in a particular fashion. Various computer-readable media may be utilized to provide instructions to the processing unit 906 for execution. Example tangible, computer-readable media may include, but is not limited to, volatile media, non-volatile media, removable media and non-removable media implemented in any method or technology for storage of information such as computer readable instructions, data structures, program modules or other data. System memory 904, removable storage 908, and non-removable storage 910 are all examples of tangible, computer storage media. Example tangible, computer-readable recording media include, but are not limited to, an integrated circuit (e.g., field-programmable gate array or application-specific IC), a hard disk, an optical disk, a magneto-optical disk, a floppy disk, a magnetic tape, a holographic storage medium, a solid-state device, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices.

In an example implementation, the processing unit 906 may execute program code stored in the system memory 904. For example, the bus may carry data to the system memory 904, from which the processing unit 906 receives and executes instructions. The data received by the system memory 904 may optionally be stored on the removable storage 908 or the non-removable storage 910 before or after execution by the processing unit 906.

It should be understood that the various techniques described herein may be implemented in connection with hardware or software or, where appropriate, with a combination thereof. Thus, the methods and apparatuses of the presently disclosed subject matter, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computing device, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an application programming interface (API), reusable controls, or the like. Such programs may be implemented in a high level procedural or object-oriented programming language to communicate with a computer system. However, the program(s) can be implemented in assembly or machine language, if desired. In any case, the language may be a compiled or interpreted language and it may be combined with hardware implementations.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An auditory communication device, comprising:

a microphone configured to collect acoustic energy and convert the collected acoustic energy into an audio signal;

a processor operably coupled to the microphone; and a memory operably coupled to the processor, the memory having computer-executable instructions stored thereon that, when executed by the processor, cause the processor to:

receive the audio signal from the microphone, create a time-frequency (T-F) representation of the audio signal, wherein the T-F representation of the audio signal comprises a plurality of T-F units, classify each of the T-F units into one of N discrete categories, wherein N is an integer greater than 2, attenuate the T-F representation of the audio signal, wherein a respective level of attenuation for each of the T-F units is determined by its respective classification, and create a synthesized signal from the attenuated T-F representation of the audio signal, wherein:

each of the T-F units is classified into one of N discrete categories using a machine-learning algorithm, wherein the machine-learning algorithm is a neural network, and the neural network is a deep neural network (DNN), a recurrent neural network (RNN), a convolutional neural network (CNN), a perceptron, a long-short term memory (LSTM), a gated recurrent unit (GRU), a Hopfield network (HN), a Boltzmann machine, a deep belief network, an autoencoder, a generative adversarial network (GAN), a bitwise neural network, or a binarized neural network.

2. The auditory communication device of claim 1, wherein N is greater than or equal to 4.

3. The auditory communication device of claim 2, wherein N is less than or equal to 8.

4. The auditory communication device of claim 1, wherein each of the N discrete categories is associated with a different level of attenuation.

5. The auditory communication device of claim 1, wherein each of the T-F units is classified into one of N discrete categories based on its signal-to-noise ratio (SNR).

6. The auditory communication device of claim 1, wherein the N discrete categories are created based on an ideal ratio mask (IRM) function.

7. The auditory communication device of claim 6, wherein the respective levels of attenuation corresponding to each of the N discrete categories are based on the IRM function.

8. The auditory communication device of claim 1, further comprising a receiver operably coupled to the processor, wherein the receiver is configured to convert the synthesized signal into acoustic energy.

9. The auditory communication device of claim 1, wherein the auditory communication device comprises a single microphone.

10. The auditory communication device of claim 1, wherein the audio signal comprises a target signal and noise.

11. The auditory communication device of claim 1, wherein the synthesized signal improves detection or understandability of the audio signal.

12. The auditory communication device of claim 1, wherein a signal-to-noise ratio (SNR) of the synthesized signal is greater than a SNR of the audio signal.

13. The auditory communication device of claim 1, wherein the auditory communication device is a hearing aid, cochlear implant, telephone, public address system, headset communication device, vehicle communication device, military communication device, aviation communication device, two-way radio, or walkie-talkie.

14. A monaural auditory processing method, comprising:

using a microphone, receiving acoustic energy and converting the acoustic energy into an audio signal;

using a computing device, receiving the audio signal from the microphone;

using the computing device, creating a time-frequency (T-F) representation of the audio signal, wherein the T-F representation of the audio signal comprises a plurality of T-F units;

using the computing device, classifying each of the T-F units into one of N discrete categories, wherein N is an integer greater than 2;

using the computing device, attenuating the T-F representation of the audio signal, wherein a respective level of attenuation for each of the T-F units is determined by its respective classification; and using the computing device, creating a synthesized signal from the attenuated T-F representation of the audio signal, wherein:

each of the T-F units is classified into one of N discrete categories using a machine-learning algorithm, wherein the machine-learning algorithm is a neural network, and the neural network is a deep neural network (DNN), a recurrent neural network (RNN), a convolutional neural network (CNN), a perceptron, a long-short term memory (LSTM), a gated recurrent unit (GRU), a Hopfield network (HN), a Boltzmann machine, a deep belief network, an autoencoder, a generative adversarial network (GAN), a bitwise neural network, or a binarized neural network.

15. A computer-implemented auditory processing method, comprising:

receiving an audio signal;

creating a time-frequency (T-F) representation of the audio signal, wherein the T-F representation of the audio signal comprises a plurality of T-F units;

classifying each of the T-F units into one of N discrete categories, wherein N is an integer greater than 2;

attenuating the T-F representation of the audio signal, wherein a respective level of attenuation for each of the T-F units is determined by its respective classification; and creating a synthesized signal from the attenuated T-F representation of the audio signal, wherein:

each of the T-F units is classified into one of N discrete categories using a machine-learning algorithm, wherein the machine-learning algorithm is a neural network, and the neural network is a deep neural network (DNN), a recurrent neural network (RNN), a convolutional neural network (CNN), a perceptron, a long-short term memory (LSTM), a gated recurrent unit (GRU), a Hopfield network (HN), a Boltzmann machine, a deep belief network, an autoencoder, a generative adversarial network (GAN), a bitwise neural network, or a binarized neural network.

* * * * *